US007781134B2

(12) United States Patent
Takada et al.

(10) Patent No.: US 7,781,134 B2
(45) Date of Patent: Aug. 24, 2010

(54) ELECTROPHOTOGRAPHIC PHOTORECEPTOR, IMAGE FORMING METHOD, IMAGE FORMING APPARATUS AND PROCESS CARTRIDGE FOR THE IMAGE FORMING APPARATUS

(75) Inventors: Takeshi Takada, Tokyo (JP); Takaaki Ikegami, Tokyo (JP); Akihiro Sugino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

(21) Appl. No.: 11/317,302

(22) Filed: Dec. 27, 2005

(65) Prior Publication Data

US 2006/0141378 A1 Jun. 29, 2006

(30) Foreign Application Priority Data

Dec. 27, 2004 (JP) ..... 2004-377980
Feb. 9, 2005 (JP) ..... 2005-032824
May 24, 2005 (JP) ..... 2005-151273

(51) Int. Cl.
*G03G 5/05* (2006.01)

(52) U.S. Cl. ..... 430/59.6; 430/66; 430/132; 430/125.1; 430/159

(58) Field of Classification Search ..... 430/59.6, 430/66, 132, 125.1, 159
See application file for complete search history.

(56) References Cited

U.S. PATENT DOCUMENTS 5,030,533 A * 7/1991 Bluhm et al. ..... 430/58.8
5,578,405 A 11/1996 Ikegami et al.
5,702,855 A 12/1997 Ikegami et al.
6,030,736 A 2/2000 Ikegami et al.
6,187,493 B1 * 2/2001 Katsukawa et al. ..... 430/83
6,599,671 B2 * 7/2003 Mitsumori et al. ..... 430/96
6,618,565 B2 9/2003 Tamiya et al.
6,741,821 B2 5/2004 Sugino et al.
6,777,149 B2 8/2004 Ikegami et al.
6,777,150 B2 8/2004 Suzuki et al.
6,785,500 B2 8/2004 Takahashi et al.
6,816,691 B2 11/2004 Kabata et al.

(Continued)

FOREIGN PATENT DOCUMENTS

JP 2000-284508 10/2000

(Continued)

OTHER PUBLICATIONS

U.S. Appl. No. 11/873,876, filed Oct. 17, 2007, Nakamori, et al.

(Continued)

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

A photoreceptor is provided having an electroconductive substrate and a photosensitive layer located overlying the electroconductive substrate, wherein an outermost layer of the photoreceptor contains a binder resin, wherein the binder resin solution satisfies the following relationship $2 \leqq (T_0 - T_{400})/C$ wherein $T_0$ represents a initial transmittance (%) at 400 nm of the binder resin solution; $T_{400}$ represents a transmittance (%) at 400 nm of the binder resin solution which has been allowed to settle for 400 hours under conditions of 23° C. and 40% RH; and C represents the concentration of the binder resin solution; and an image forming method, an image forming apparatus and a process cartridge including the photoreceptor.

19 Claims, 8 Drawing Sheets

U.S. PATENT DOCUMENTS

| | | | | |
|---|---|---|---|---|
| 6,824,939 | B2 | 11/2004 | Kurimoto et al. | |
| 6,829,450 | B2 | 12/2004 | Tamiya et al. | |
| 6,830,858 | B2 | 12/2004 | Sugino et al. | |
| 6,853,823 | B2 | 2/2005 | Sugino et al. | |
| 6,853,834 | B2 | 2/2005 | Kurimoto et al. | |
| 6,861,188 | B2 | 3/2005 | Ikegami et al. | |
| 2003/0064309 | A1* | 4/2003 | Komoto et al. | 430/106.1 |
| 2003/0077531 | A1* | 4/2003 | Suzuki et al. | 430/66 |
| 2003/0118359 | A1 | 6/2003 | Ogiyama et al. | |
| 2003/0190545 | A1* | 10/2003 | Daimon et al. | 430/124 |
| 2003/0215726 | A1 | 11/2003 | Sugino et al. | |
| 2004/0126687 | A1 | 7/2004 | Ikegami et al. | |
| 2004/0170911 | A1 | 9/2004 | Shimada et al. | |
| 2004/0180280 | A1 | 9/2004 | Ikegami et al. | |
| 2004/0197687 | A1 | 10/2004 | Suzuki et al. | |
| 2004/0229147 | A1 | 11/2004 | Higuchi et al. | |
| 2005/0008957 | A1 | 1/2005 | Ikegami et al. | |
| 2005/0026058 | A1 | 2/2005 | Kami et al. | |
| 2005/0053853 | A1 | 3/2005 | Sugino et al. | |
| 2005/0105942 | A1 | 5/2005 | Kurimoto et al. | |
| 2005/0118518 | A1 | 6/2005 | Ikegami et al. | |
| 2005/0130050 | A1 | 6/2005 | Takada et al. | |
| 2005/0201778 | A1 | 9/2005 | Takada et al. | |
| 2009/0017392 | A1 | 1/2009 | Higuchi et al. | |

FOREIGN PATENT DOCUMENTS

| | | |
|---|---|---|
| JP | 2002-221886 | 8/2002 |
| JP | 2002-318460 | 10/2002 |
| JP | 2003-131537 | 5/2003 |
| JP | 2003-262965 | 9/2003 |
| JP | 2004-151535 | 5/2004 |
| JP | 2004-251923 | 9/2004 |
| JP | 2005-10744 | 1/2005 |

OTHER PUBLICATIONS

U.S. Appl. No. 11/876,396, filed Jan. 22, 2007, Nakamori, et al.
U.S. Appl. No. 11/561,983, filed Nov. 21, 2006, Sugino, et al.
U.S. Appl. No. 11/695,750, filed Apr. 3, 2007, Takada, et al.
U.S. Appl. No. 11/762,296, filed Jun. 13, 2007, Gondoh, et al.
U.S. Appl. No. 12/030,886, filed Feb. 14, 2008, Toda, et al.
Japanese Office Action dated May 11, 2010.

* cited by examiner

ELECTROPHOTOGRAPHIC PHOTORECEPTOR, IMAGE FORMING METHOD, IMAGE FORMING APPARATUS AND PROCESS CARTRIDGE FOR THE IMAGE FORMING APPARATUS

BACKGROUND OF THE INVENTION

1. Field of the Invention

The present invention relates to an electrophotographic photoreceptor. The present invention also relates to an image forming method, an image forming apparatus and a process cartridge using the electrophotographic photoreceptor, such as copiers, facsimile machines and laser printers.

2. Discussion of the Background

Recently, development of information processing systems utilizing electrophotography has been remarkable. In particular, optical printers in which information converted to digital signals is recorded using light have been dramatically improved in print qualities and reliability. This digital recording technique is being applied not only to printers but also to copiers which can produce documents including color images. Thus, photoreceptors are required to produce high quality images and to have high durability.

To produce high definition images, the particle diameter of toner, both pulverized toner and polymerization toner, is decreased more and more. However, such a toner having a small particle diameter has a low fluidity and a relatively large adherence. Therefore the toner has poor cleanability. As the diameter of toner decreases, the surface area of the toner per unit volume increases. In attempting to improve fluidity, a large amount of external additive is added to a toner having a small particle diameter. However, good cleanability cannot be imparted to toner by such a technique.

On the other hand, in attempting to produce a high definition image, a spherical toner which has good development and transfer properties is commonly used. The spherical toner has a high fluidity but tends to rotate on the surface of the photoreceptor. Therefore the spherical toner slips through a cleaning blade, and thereby the toner is insufficiently cleaned, especially in a high-speed image forming apparatus.

In addition, there are many types of cleaning methods such as brush cleaning methods and blade cleaning methods etc. Among these cleaning methods, the blade cleaning methods are typically used because of having a simple structure and lower cost.

The cleanability of a spherical toner having a small particle diameter can be improved by improving the toner or the cleaning process. For example, as one technique for improving toner, published unexamined Japanese patent application No. (hereinafter referred to as JP-A) 2003-131537 discloses an image forming apparatus. The image forming apparatus uses a toner having a diameter (d) of from 4 to 10 μm, and a flattening factor t/d, a ratio of a diameter (d) and a thickness (t) of the toner particle, of from 2 to 5. By using such a toner, the stress applied to the toner by a cleaning blade can be decreased, and the toner collected by the cleaning device is recycled. This image forming apparatus includes the cleaning blade made of a rubber, and a means of feeding toner collected from the cleaning device to a developing device.

As one technique for improving the process, JP-A 2002-221886 discloses an image forming method using a photoreceptor having a surface layer including a siloxane-containing resin. In the method, the following relationship is satisfied;

$$0.2 \geqq Y100 - Y0 \geqq 0.01,\ 2.95 \geqq Y100/Y0 \geqq 1.15$$

wherein Y0 (N·m) represents an average value of dynamic torque generated between the photoreceptor and the cleaning blade, and Y100 (N·m) represents an average value of dynamic torque generated between the photoreceptor and the cleaning blade when a 100% solid image is formed on the photoreceptor.

However, these methods cannot sufficiently improve the cleanability of a spherical toner having a small particle diameter.

SUMMARY OF THE INVENTION

Accordingly, an object of the present invention is to provide an electrophotographic photoreceptor such that residual toner thereon can be well removed by a cleaning blade even when the toner is a spherical toner having a small particle diameter, and which has high durability so as to stably produce high quality images after long repeated use.

Another object of the present invention is to provide an image forming method, an image forming apparatus, and a process cartridge using the electrophotographic photoreceptor by which high quality images can be stably produced even when a spherical toner having a small particle diameter is used.

These and other objects of the present invention, either individually or in combinations thereof, as hereinafter will become more readily apparent can be attained by a photoreceptor which includes:

an electroconductive substrate; and a photosensitive layer located overlying the electroconductive substrate, wherein an outermost layer of the photoreceptor includes a binder resin, wherein the outermost layer is prepared by a method including:

dissolving the binder resin in a solvent at a concentration of C % by weight;

coating a coating liquid including the binder resin solution; and drying the coated liquid, wherein the binder resin solution satisfies the following relationship (1):

$$2 \leqq (T_0 - T_{400})/C \quad (1)$$

wherein $T_0$ represents an initial transmittance (%) at 400 nm of the binder resin solution; $T_{400}$ represents a transmittance (%) at 400 nm of the binder resin solution which has been allowed to settle for 400 hours under conditions of 23° C. and 40% RH; and C represents the concentration of the binder resin solution; and an image forming method, image forming apparatus and process cartridge for the image forming apparatus, using the photoreceptor.

BRIEF DESCRIPTION OF THE FIGURES

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
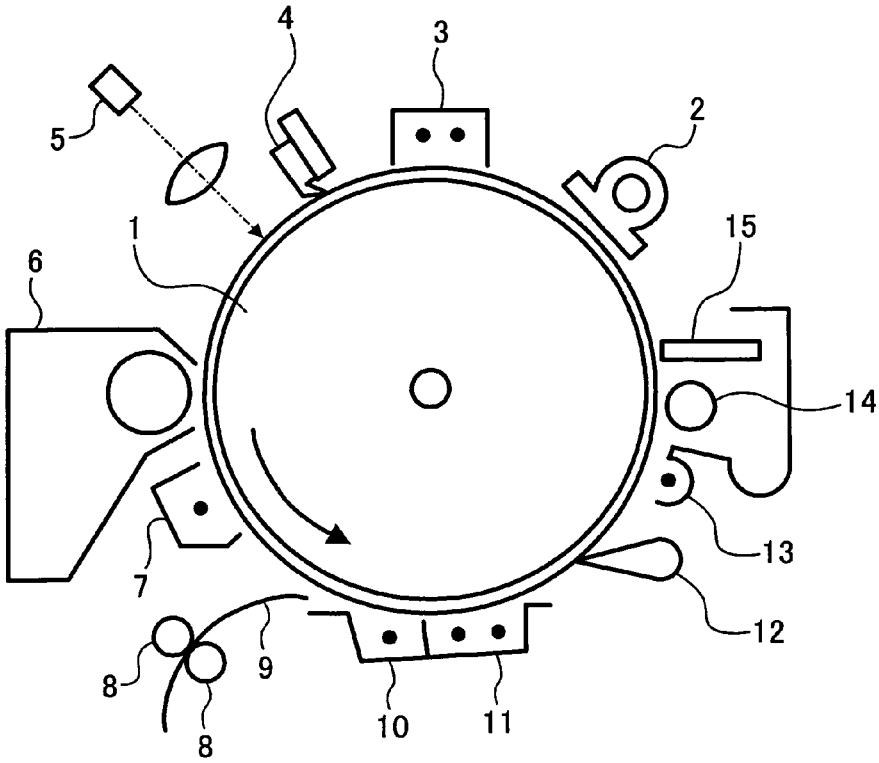
FIG. 1 is a schematic view illustrating an image forming section of an embodiment of the image forming apparatus of the present invention.

The present invention relates to a photoreceptor which comprises:

an electroconductive substrate; and a photosensitive layer located overlying the electroconductive substrate, wherein an outermost layer of the photoreceptor comprises a binder resin, wherein the outermost layer is prepared by a method comprising:

dissolving the binder resin in a solvent at a concentration of C % by weight;

coating a coating liquid including the binder resin solution; and drying the coated liquid, wherein the binder resin solution satisfies the following relationship (1):

$$2 \leqq (T_0 - T_{400})/C \quad (1)$$

wherein $T_0$ represents an initial transmittance (%) at 400 nm of the binder resin solution; $T_{400}$ represents a transmittance (%) at 400 nm of the binder resin solution which has been allowed to settle for 400 hours under conditions of 23° C. and 40% RH; and C represents the concentration of the binder resin solution.

The outermost layer may be the photosensitive layer (preferably, a charge transport layer) or a protective layer.

The binder resin preferably includes a polycarbonate resin and a crystalline polyester resin.

The crystalline polyester resin preferably includes a unit having the following formula (I):

$$[—O—CO—(CR_1{=}CR_2)_m—CO—O—(CH_2)_n—] \quad (I)$$

wherein each of R1 and R2 independently represents a hydrogen atom or a hydrocarbon group; and each of m, n and p is an integer.

The crystalline polyester resin preferably includes a unit obtained from a diol having from 2 to 6 carbon atoms and a unit obtained from an acid selected from the group consisting of fumaric acid, maleic acid and succinic acid.

The polycarbonate resin solution used for preparing the binder resin solution preferably satisfies the following relationship (2):

$$(2).\quad 2 \leqq (T_0 - T_{400})/C \leqq 3$$

The binder resin preferably includes a resin having the following formula (II):

(II)

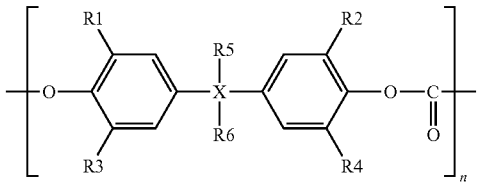

wherein X represents a carbon atom or a single bond (when X is a single bond, R5 and R6 do not exist); R1, R2, R3, and R4 each, independently, represent a hydrogen atom, a halogen atom, an alkyl group which may have a substituent group, or an aryl group; R5 and R6 each, independently, represent a hydrogen atom, a halogen atom, an alkyl group which may have a substituent group, an cycloalkyl group which may have a substituent group, or an aryl group, wherein R5 and R6 optionally share a bond connectively to form an alkylidene group.

The binder resin preferably includes a resin having the following formula (III):

(III)

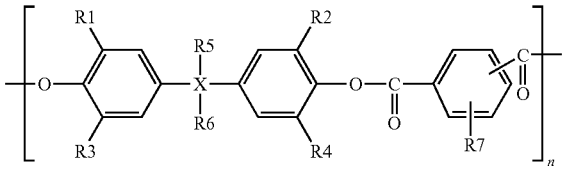

wherein X represents a carbon atom or a single bond (when X is a single bond, R5 and R6 do not exist); R1, R2, R3, and R4 each, independently, represent a hydrogen atom, a halogen atom, an alkyl group which may have a substituent group, or an aryl group; R5 and R6 each, independently, represent a hydrogen atom, a halogen atom, an alkyl group which may have a substituent group, an cycloalkyl group which may have a substituent group, or an aryl group, wherein R5 and R6 optionally share bond connectively to form an alkylidene group; R7 represents a hydrogen atom, a halogen atom, an alkyl group which may have a substituent group, a cycloalkyl group which may have a substituent group, or an aryl group.

It is preferable that the outermost layer further comprises a charge transport material.

As another aspect of the present invention, an image forming method is provided which comprises:

charging at least one image bearing member;

irradiating the charged image bearing member with image-wise light to form an electrostatic latent image on a surface of the at least one image bearing member;

developing the electrostatic latent image with a developer including a toner to form at least one toner image on the surface of the at least one image bearing member;

transferring the at least one toner image onto a transfer material optionally via an intermediate transfer medium; and cleaning the surface of the at least one image bearing member, wherein the at least one image bearing member is the photoreceptor mentioned above, and the toner has an average circularity of from 0.93 to 0.99.

The toner preferably has a weight average particle diameter of from 2.5 to 6.5 μm.

It is preferable that the toner comprises wax particles, and wherein the wax particles comprise particles having a particle diameter of from 0.1 to 1 μm in an amount of not less than 70% by number.

The toner is preferably prepared by a method comprising:

dissolving or dispersing a toner constituent mixture comprising a polymer capable of reacting with an active hydrogen atom, a polyester resin, a colorant and a release agent, in an organic solvent to prepare a toner constituent mixture liquid; and dispersing the toner constituent mixture liquid in an aqueous medium while subjecting the polymer to at least one of an extension reaction and a crosslinking reaction using a compound having an active hydrogen atom, to prepare a dispersion comprising toner particles in the presence of a particulate resin.

The toner preferably includes an external additive having an average primary diameter of from 50 to 500 nm, and an apparent density of not less than 0.3 g/cm$^3$.

It is preferable that the cleaning includes; rubbing the surface of the image bearing member with a member.

It is also preferable that the member is one member selected from the group consists of a charging roller configured to charge the image bearing member, a cleaning blade configured to clean the surface of the at least one image bearing member, a cleaning brush configured to clean the surface of the at least one image bearing member, the intermediate transfer medium and a member applying a solid lubricant agent to the surface of the photoreceptor.

It is further preferable that the irradiating is performed using a laser diode or a light emitting diode.

As another aspect of the present invention, an image forming apparatus is provided which comprises:

an image bearing member;

a charger configured to charge the image bearing member;

a light irradiator configured to irradiate the charged image bearing member with imagewise light to form an electrostatic latent image on a surface of the image bearing member;

a developing device configured to develop the electrostatic latent image with a developer including a toner to form at least one toner image on the surface of the image bearing member;

a transferring device configured to transfer the toner image onto a transfer material optionally via an intermediate transfer medium; and a cleaner configured to clean the surface of the image bearing member, wherein the image bearing member is the photoreceptor mentioned above, and the toner has an average circularity of from 0.93 to 0.99.

As another aspect of the present invention, a process cartridge is provided which comprises:

an image bearing member configured to bear an electrostatic latent image thereon; and a developing device configured to develop the electrostatic latent image with a developer including a toner to form a toner image on the image bearing member, wherein the image bearing member is the photoreceptor mentioned above, and the toner has an average circularity of from 0.93 to 0.99.

Next, the image forming apparatus of the present invention will be explained in detail.

FIG. 1 is a schematic view illustrating an embodiment of the image forming apparatus of the present invention.

Referring to FIG. 1, a photoreceptor 1 is the photoreceptor of the present invention, which includes at least a photosensitive layer and an outermost layer including filler. Although the photoreceptor 1 as shown has a cylindrical form, sheet-form photoreceptors and endless belt-form photoreceptors can also be used. As a charging device 3, a pre-transfer charger 7, a transfer charger 10, a separating charger 11 and a pre-cleaning charger 13, all known chargers such as corotrons, scorotrons, solid state chargers, roller chargers and brush chargers can be used.

As a transfer device, the above-mentioned chargers can be used. Preferably, a transfer charger and a separating charger are used in combination as shown in FIG. 1.

Suitable light sources for use in a light irradiator 5 and a discharging lamp 2 include fluorescent lamps, tungsten lamps, halogen lamps, mercury lamps, sodium lamps, light emitting diodes (LEDs), laser diodes (LDs), light sources using electroluminescent lamps (EL), and the like. In addition, in order to obtain light having a desired wave length range, filters such as sharp-cut filters, band pass filters, near-infrared cutting filters, dichroic filters, interference filters, color temperature converting filters and the like can be used. Among these light sources, LEDs and LDs are preferably used in the present invention.

The above-mentioned lamps can be used not only for the process mentioned above and illustrated in FIG. 1, but also for other processes using light irradiation, such as a transfer process including light irradiation, a discharging process, a cleaning process including light irradiating and pre-exposure process.

Referring to FIG. 1, when the toner image formed on the photoreceptor 1 by a developing device 6 is transferred onto a receiving paper 9, all of the toner particles of the toner images are not transferred on the receiving paper 9, and some toner particles remain on the surface of the photoreceptor 1. The residual toner particles are removed from the photoreceptor 1 by a fur brush 14 or a cleaning blade 15. The residual toner particles remaining on the photoreceptor 1 can be removed only by a cleaning brush. Suitable cleaning brushes include known cleaning brushes such as fur brushes and mug-fur brushes.

When the photoreceptor 1, which is previously charged positively (or negatively), is exposed to imagewise light, an electrostatic latent image having a positive (or negative) charge is formed on photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

As the developing method, known developing methods can be used. In addition, as the discharging methods, known discharging methods can also be used.

In the image forming apparatus of the present invention, a contact member which rubs the photoreceptor can also be present.

Specific examples of the contact members include contact members configured to apply a solid lubricant; and the members generally used in the image forming apparatus such as contact charging members (charging roller), cleaning members (cleaning blade, cleaning brush), and transfer members (transfer belt, intermediate transfer belt), having a pressure application system. The case wherein the photoreceptor is rubbed by the cleaning blade will be explained below. The cleaning blade applies pressure uniformly to the surface of the photoreceptor and rubs all over the surface and removes the residual toner particles. In FIG. 1, 4 represents an eraser, 8 represents registration rollers, 12 represents a separating pick.

Figure 2:
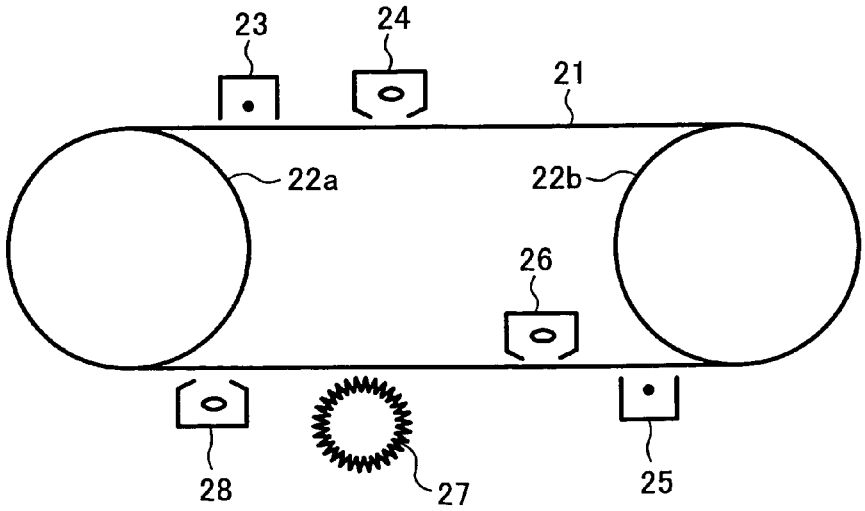
FIG. 2 is a schematic view illustrating an image forming section of another embodiment of the image forming apparatus of the present invention.

FIG. 2 illustrates another embodiment of the image forming apparatus of the present invention. The photoreceptor 21 includes at least a photosensitive layer and an outermost protective layer. The photoreceptor 21 is rotated by rollers 22*a* and 22*b*. The photoreceptor 21 is charged with a charger 23, and then exposed to imagewise light emitted by a light irradiating device 24 to form an electrostatic image on the photoreceptor 21. The latent image is developed with a developing device (not shown) to form a toner image on the photoreceptor 21. The toner image is transferred onto a receiving paper (not shown) using a transfer charger 25. After the toner image transferring process, the surface of the photoreceptor 21 is cleaned with a cleaning brush 27 after performing a pre-cleaning light irradiator 26. Then the photoreceptor 21 is discharged by being exposed to light emitted by a discharging light source 28. In the pre-cleaning light irradiating process, light irradiates the photoreceptor 21 from the substrate side of the photoreceptor 21. In this case, the substrate has to be light-transmissive.

The image forming apparatus of the present invention is not limited to the image forming apparatus as shown in FIGS. 1 and 2. For example, in FIG. 2, the pre-cleaning light irradiating operation is performed from the substrate side of the photoreceptor 21, but it can be performed from the photosensitive layer side of the photoreceptor 21. In addition, the light irradiation in the light image irradiating process and the discharging process may be performed from the substrate side of the photoreceptor 21.

Further, a pre-transfer light irradiation operation, which is performed before the transferring of the toner image, and a preliminary light irradiation operation, which is performed before the imagewise light irradiation, and other light irradiation operations may also be performed.

Figure 3:
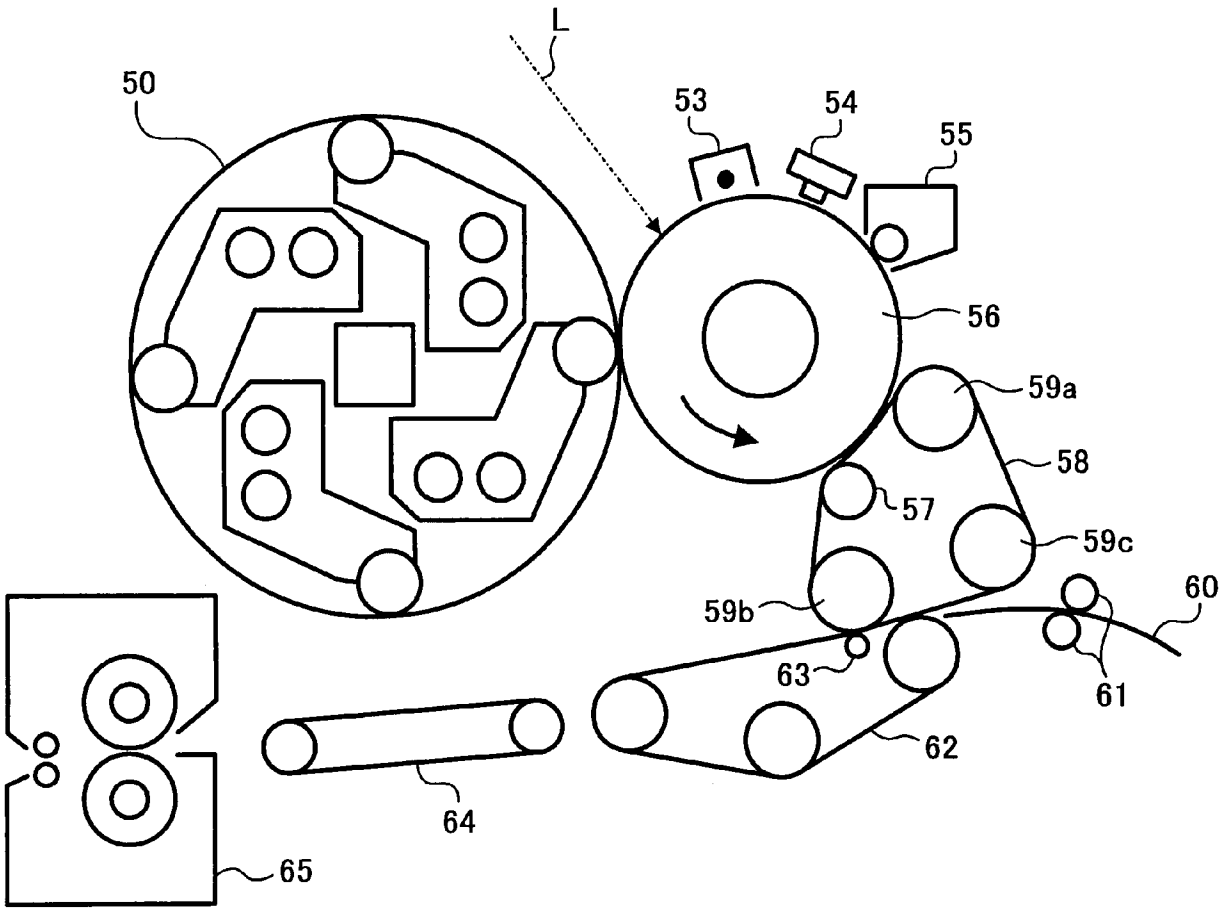
FIG. 3 is a schematic view illustrating another embodiment (a revolver type image forming apparatus) of the image forming apparatus of the present invention.

FIG. 3 is the overview of another embodiment of the image forming apparatus of the present invention.

A photoreceptor 56 serving as an image bearing member is rotated in the counterclockwise direction. The surface of the photoreceptor 56 is uniformly charged with a charger 53, and is exposed to a laser light beam L emitted by a laser optical device (not shown), to form an electrostatic latent image on the photoreceptor 56. The laser light beam scanning is performed based on single color information (yellow, magenta, cyan and black color information) obtained by color separating of an original full color image. Thus single-color images (yellow, magenta, cyan and black) are formed on the photoreceptor 56. On the left side of the photoreceptor 56, a revolver developing device 50 is arranged. The revolver developing device 50 includes a yellow developing unit, a magenta developing unit, a cyan developing unit and a black developing unit inside a rotating cylinder, and rotates each developing unit to transport the developing unit to a developing point facing the photoreceptor 56. The yellow developing unit, the magenta developing unit, the cyan developing unit and the black developing unit develop the electrostatic latent images with a yellow toner, a magenta toner, a cyan toner and a black toner, respectively. Namely, the electrostatic latent images corresponding to yellow, magenta, cyan and black images, which are formed one by one on the photoreceptor 56, are developed one by one by the respective revolver developing units 50, resulting in formations of a yellow toner image, a magenta toner image, a cyan toner image and a black toner image.

An intermediate transfer unit is arranged on a downstream side from the developing point relative to the rotating direction of the photoreceptor 56. An intermediate transfer belt 58 is tightly stretched by a stretching roller 59*a*, an intermediate transfer bias roller 57 serving as a transfer member, a secondary transfer backup roller 59*b* and a belt driving roller 59*c*. The intermediate transfer belt 58 is moved endlessly in the clockwise direction by the rotary driving force of the belt driving roller 59*c*. The yellow toner image, the magenta toner image, the cyan toner image and the black toner image formed on the photoreceptor 56 are transported to the intermediate transfer nip at which the photoreceptor 56 contacts the intermediate transfer belt 58. These images are superimposed on the intermediate transfer belt 58 while influenced by a bias applied to the intermediate transfer bias roller 57. Thus a full color toner image is formed on the intermediate transfer belt 58.

After the surface of the photoreceptor 56 passes the intermediate transfer nip by rotation, the residual toner particles are removed by a drum cleaning unit 55. The drum cleaning unit 55 removes the residual toner particles with a cleaning roller to which a cleaning bias is applied. Cleaning brushes such as fur brushes or mug-fur brushes and cleaning blades can be used instead of cleaning roller.

After the residual toner is removed, the surface of the photoreceptor 56 is discharged by a discharging lamp 54. Specific examples of the discharging lamp 54 include fluorescent lamps, tungsten lamps, halogen lamps, mercury lamps, sodium lamps, light emitting diodes (LEDs), laser diodes (LDs), light sources using electroluminescent lamps (EL), and like. A laser diode is used for the laser optical device mentioned above. In addition, in order to obtain light having a desired wave length range, filters such as sharp-cut filters, band pass filters, near-infrared cutting filters, dichroic filters, interference filters, color temperature converting filters and the like can be used.

A receiving paper 60 serving as a receiving material is fed from a feeding cassette (not shown) and is stopped by a pair of registration rollers 61. Then the receiving paper 61 is timely fed to the secondary intermediate transfer nip such that the color toner images superimposed on the intermediate transfer belt 58 are transferred onto the receiving paper 60. The color toner images superimposed on the intermediate transfer belt 58 are transferred onto the recording paper 60 at once at the secondary transfer nip while influenced by the secondary transfer bias applied to a paper transfer bias roller 63.

The receiving paper 60 having the full color image thereon is then transported to a transport belt 64 by a transfer belt 62.

The transport belt 64 transports the receiving paper 60 from the transfer unit to a fixing unit 65.

The fixing device 65 transports the receiving paper 60 through the fixing nip formed between a heating roller and a backup roller.

The full color image on the receiving paper 60 is fixed on the receiving paper 60 by the heat of the heating roller and the pressure of the backup roller.

A bias is applied to the transfer belt 62 or the transport belt 64 so that the receiving paper 60 is attracted thereto. In addition, a paper discharger configured to discharge the receiving paper 60, and three belt chargers configured to discharge the respective belts (i.e., the intermediate transfer belt 58, the transfer belt 62 and the transport belt 64) are arranged. Moreover, the intermediate transfer unit includes a belt cleaning unit having the same configuration as that of the drum cleaning unit 55 to remove the residual toner particles on the intermediate transfer belt 58. These are not shown in the figures.

Figure 4:
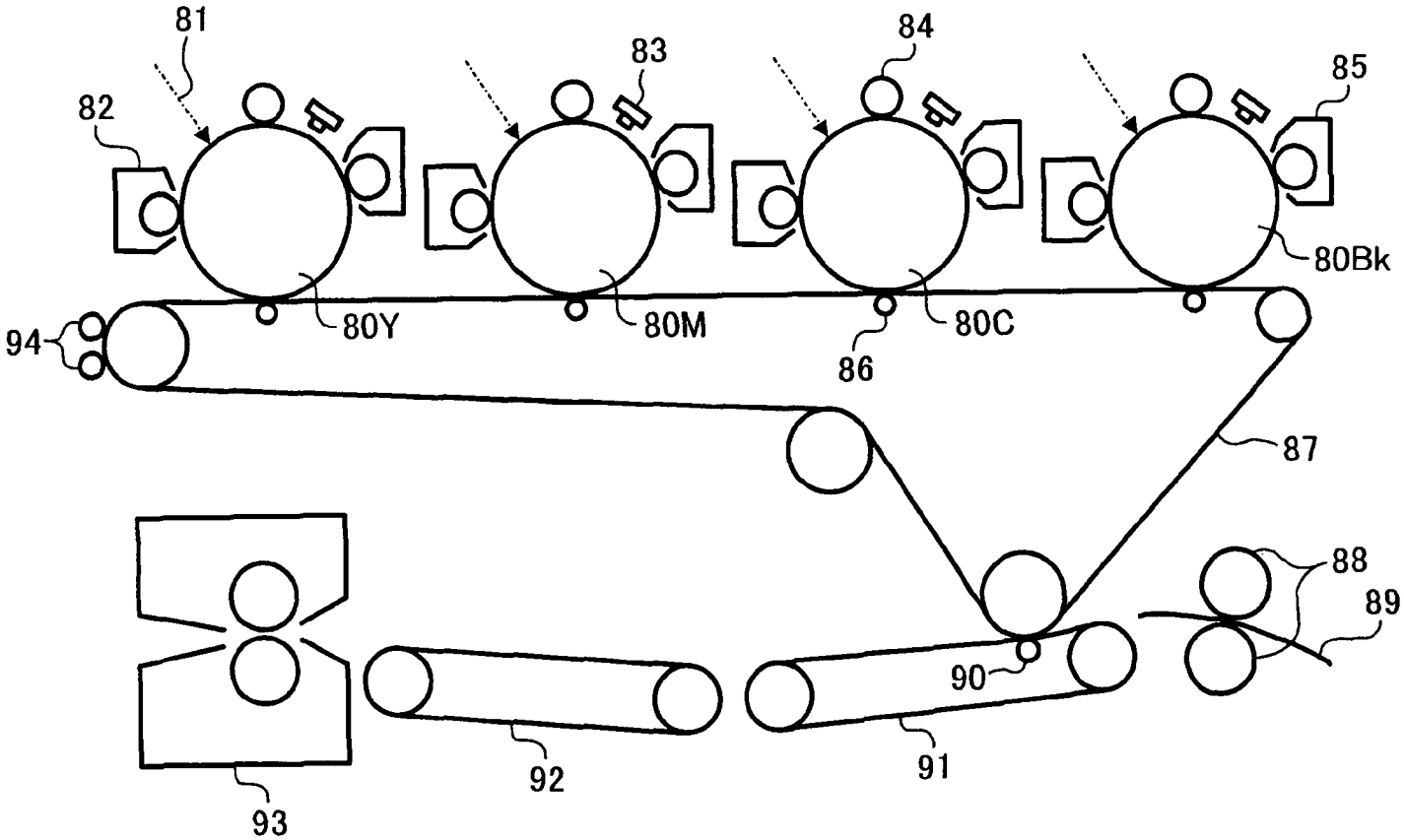
FIG. 4 is a schematic view illustrating another embodiment (a tandem type image forming apparatus) of the image forming apparatus of the present invention.

FIG. 4 is the overview of another embodiment of the image forming apparatus of the present invention, which is a tandem-type color image forming apparatus having an intermediate transfer belt 87. In FIG. 4, the tandem type image forming apparatus has photoreceptors 80Y, 80M, 80C and 80Bk for each color. The tandem type image forming apparatus also has cleaning units 85, discharging lamps 83, charging rollers 84 configured to charge the photoreceptors respectively for each color. The image forming apparatus shown in FIG. 3 has the charger 53 while the image forming apparatus shown in FIG. 4 has charging rollers 84.

When the tandem type image forming apparatus is used, formation of the electrostatic latent images and development of each color can be performed in parallel. Therefore the image forming speed of the tandem type image forming apparatus is much faster than that of the revolver type image forming apparatus. The image forming apparatus shown in FIG. 4 includes irradiating lights 81 configured to form an electrostatic latent image, developing units 82 configured to form a toner image on the photoreceptor, discharging lamps 83, an intermediate transfer unit including the intermediate transfer belt 87 as mentioned above, bias rollers 86 and fur brushes 94. In addition, in order to form the full color images on a paper 89 as a receiving material, the image forming apparatus shown in FIG. 4 includes registration rollers 88, a paper transfer bias roller 90, a transfer belt 91 and a transport belt 92. The full color toner images are fixed in a fixing unit 93.

Figure 5:
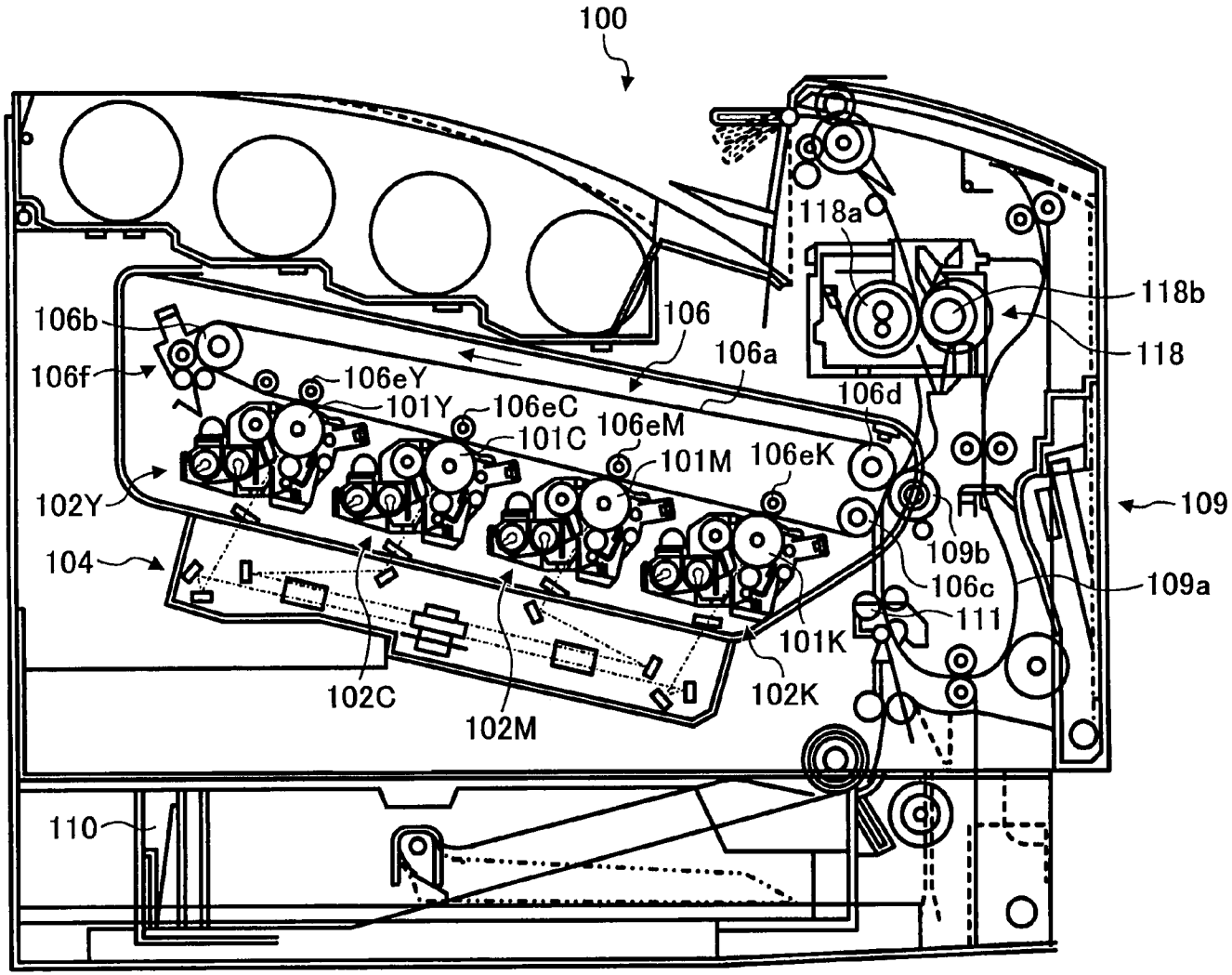
FIG. 5 is a schematic view illustrating another embodiment (another tandem type image forming apparatus) of the image forming apparatus of the present invention.
Figure 6:
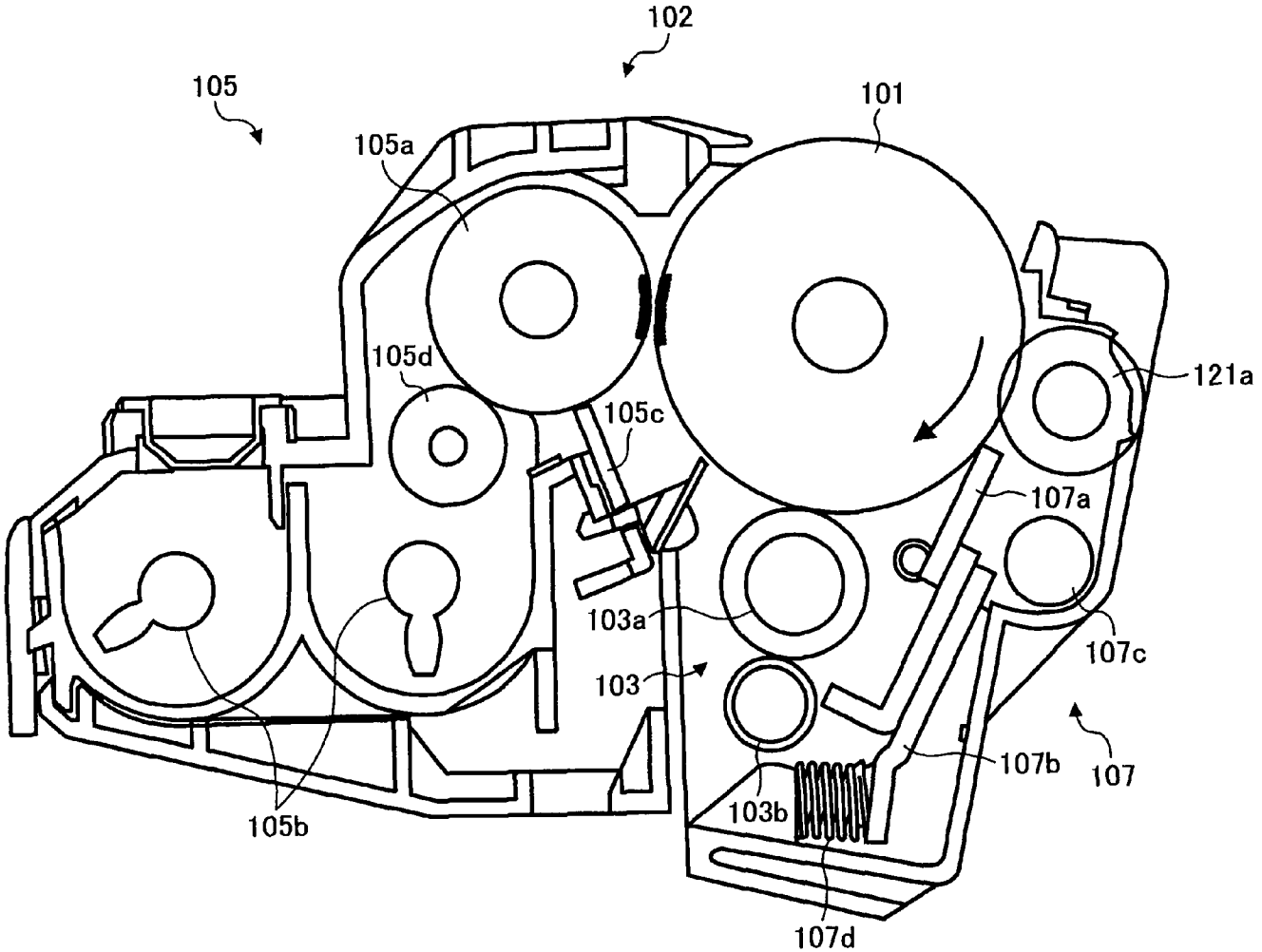
FIG. 6 is a schematic view illustrating an embodiment of the process cartridge of the present invention.

FIG. 5 is a schematic view illustrating another embodiment of the image forming apparatus of the present invention. FIG. 6 is a schematic view illustrating an embodiment of the process cartridge 102 of the present invention which can be set in the image forming apparatus illustrated in FIG. 5. The image forming apparatus 100 is a tandem-type image forming apparatus, and it forms color images using four color toners, i.e., yellow, cyan, magenta, and black toners. The image forming apparatus 100 includes four photoreceptors, 101Y, 101C, 101M and 101K, as image bearing members. Each photoreceptor 110Y, 101C, 101M and 101K contacts with an intermediate transfer belt 106*a* serving as an image bearing member, while rotating in the direction indicated by an arrow.

Process cartridges 102Y, 102C, 102M and 102K have respective photoreceptors 101Y, 101C, 101M and 101K, which have the same configuration, and therefore only one process cartridge is shown in FIG. 6. Symbols Y, C, M and K, which represent each of the colors, are omitted from the reference number. Around the photoreceptor 101, a developing device 105 configured to develop a latent image with a toner, a discharging device (not shown) configured to remove an electric potential of the photoreceptor 101, a cleaning device 107 configured to clean the toner on a surface of the photoreceptor 101 and a charging device 103 configured to charge the photoreceptor 101, are arranged in the rotation direction of the photoreceptor.

The configuration of the image forming apparatus 100 will be explained referring to FIG. 5 and FIG. 6. The charging device 103 negatively charges the surface of the photoreceptor 101. The charging device 103 includes a charging roller 103*a* serving as a charging member which charges the photoreceptor 101 by contacting or being set closely to the photoreceptor. The charging device 103 charges the surface of the photoreceptor 101 by contacting or being set closely to the photoreceptor 101, while a bias is applied to the charging roller 103*a*. A DC bias is applied to the charging roller 103*a* to charge the surface of the photoreceptor 101 to a potential of from 200 to 700 volts. As a charging bias, an AC bias overlapped with a DC bias is also usable. The charging device 103 also includes a cleaning roller 103*b* configured to clean the surface of the charging roller 103*a*.

In case the toner adheres to the charging roller 103*a*, defective charging tends to be caused. Therefore, it is preferable to clean the surface of the charging roller 103*a* using the cleaning roller 103*b*. As the charging roller 103*a*, a charging roller in which each end in the axial direction thereof is wrapped with a thin film can be set so as to counter the surface of the photoreceptor 101. The charging roller forms a small gap, which is the same as the thickness of the film, between the surface of the charging roller 103*a* and the surface of the photoreceptor 101. Since the surface of the charging roller 103*a* and the photoreceptor 101 are thus set very closely, an occasion when the surface of the charging roller contacts with the toner decreases.

The charged surface of the photoreceptor 101 is then irradiated by a light irradiating device 104 to form an electrostatic latent image corresponding to a color image. The light irradiating device forms an electrostatic latent image on the photoreceptor 101 according to image information of the color image. In the present invention, the light irradiating device 104 illustrated in FIG. 5 is a laser type, but another type of light irradiating device such that including a LED array and a focusing device can also be used.

A developing device 105 include a developing roller 105*a*, which serves as a developer bearing member and which is partially projected from an opening of a casing of the developing device. Both two component developer and one component developer, which includes no carrier, can be used for the developing device. The developing device 105 contains a toner which is supplied from a toner bottle. The developing roller 105*a* includes a magnet roller serving as a means of generating a magnetic field, and a developing sleeve is axially rotating around the magnetic roller. The supplied toner is mixed with a carrier by a transport roller 105*b* to prepare a developer. The developer is transported to the developing roller 105*a* by a drawing roller 105*d*. The thickness of the developer drawn up on the developing roller 105*a* is controlled by a doctor blade 105*c*. The carrier in the developer forms an ear on the developing roller 105*a* due to the magnetic force caused by the magnet roller, and is carried to an area opposing to the photoreceptor 101 (the developing area). The surface of the developing roller 105*a* moves faster than the surface of the photoreceptor in the same direction, in the developing area. The ear of the carrier on the developing roller supplies the toner adhered to the carrier to the surface of the photoreceptor 101 to develop a latent image, while rubbing the surface of the photoreceptor 101. About 300 volts of a developing bias is applied to the developing device 105*a* from an electric source (not shown), to form an electric field for developing.

A transferring device 106 includes an intermediate transfer belt 106*a*. The intermediate transfer belt 106*a* is tightly stretched by three supporting rollers 106*b*, 106*c* and 106*d*, and moves endlessly in the direction indicated by an arrow. The toner images on the photoreceptors 101Y, 101C, 101M and 101K are transferred to the intermediate transfer belt by an electrostatic transfer method so that the images are overlaid. Although a transfer charger can be used for the electrostatic transfer method for use in the present invention, a transfer roller 106*e* is preferably used therefore because a toner scattering problem seldom occurs in the transferring process. An electrostatic transfer method including a transfer charger is also usable. At the backsides of the points of the intermediate transfer belt 106*a* contacting the photoreceptors 101Y, 101C, 101M and 101K, primary transfer rollers 106*e*Y, 106*e*C, 106*e*M and 106*e*K are arranged so as to serve as a transfer device. Primary transfer areas are formed between the points of the intermediate transfer belt 106*a* pressed by the primary transfer roller 106*e*, and photoreceptor 101.

When the toner images on each photoreceptor 101Y, 101C, 101M and 101K are transferred to the intermediate transfer belt 106*a*, a positive bias is applied to the primary transfer roller 106*e*. Hereby an electric field for transfer is formed in the primary transfer area (hereafter transfer area), and the toner images on each photoreceptor 101Y, 101C, 101M and 101K are electrostatically adhered and transferred to the intermediate transfer belt 106*a*.

Around the intermediate transfer belt 106*a*, the belt-cleaning device 106*f* configured to remove a residual toner from the surface of the belt 106*a* is arranged. The belt-cleaning device 106*f* includes a fur brush and a cleaning blade configured to collect the residual toner adhered to the surface of the intermediate transfer belt 106*a*. The collected toner is carried to a waste toner tank from the belt-cleaning device 106*f* by a transporter (not shown). The transfer belt 106*a* is an endless belt having a high volume resistivity of from $1.0\times10^{9}$ to $1.0\times10^{11}$ Ωcm and includes a single resin layer or plural resin layers.

An image transfer and transport device 109 (hereinafter referred to as a transfer/transport device) is shown in FIG. 5. The transfer/transport device 109 includes a transfer/transport belt 109*a* and a secondary transfer roller 109*b*. The toner images superimposed on the intermediate transfer belt 106*a* is transferred onto a recording paper transported from a paper feeding device 110. Therefore, in the image forming apparatus 100, the toner is transferred twice before the image is formed on the recording paper. In the transfer/transport device 109, a voltage having a polarity opposite to that of the toner is applied to the transfer roller 109*b*. A secondary transfer area is formed between the intermediate transfer belt 106*a* and the secondary transfer roller 109*b*. The recording paper, which serves as a recording material, is timely fed to the secondary transfer area. The recording paper is contained in a paper feeding cassette 110 arranged on a downside side from the light irradiating device 104, and is transported to the secondary transfer area by a pick-up roller and a pair of registration rollers 111, etc. The toner images superimposed on the intermediate transfer belt 106*a* are transferred onto the recording paper on the transfer/transport belt 109*a* at once in the secondary transfer area. In the secondary transfer process, a positive bias is applied to the secondary transfer roller 109*b* to form a transfer electric field, and thereby the toner image on the intermediate transfer belt 106*a* is transferred onto the recording paper.

A cleaning device 107 includes a cleaning blade 107*a*, a supporting member 107*b*, a toner collection coil 107*c* and a blade compressing spring 107*d*. The cleaning blade 107*a* removes a residual toner on the photoreceptor 101 after the transfer process. The cleaning blade 107*a* sticks to the supporting member 107*b*. The material of the supporting member 107*b* is not particularly limited, and materials such as metals, plastics, and ceramic, can be used.

The cleaning blade 107*a* is made of an elastic material having a low friction factor, such as urethane resins, silicone resins and fuluorocarbon resins. In particular, urethane elastomer, silicone elastomer and fluorosilicone elastomer are preferably used. The cleaning blade 107*a* is preferably made of a thermosetting urethane resin, especially a urethane elastomer, which has good resistance to abrasion, ozone and contamination. In this application, urethane rubbers are also considered as the urethane elastomer. The cleaning blade 107*a* preferably has a hardness (JIS-A) of from 65° to 85°. The cleaning blade 107*a* preferably has a thickness of from 0.8 to 3.0 mm, and has an extended portion of from 3 to 15 mm. Other conditions such as the contact pressure, contact angle and contact length are determined as appropriate.

A brush roller 121*a* is configured to supply a solid lubricant to the surface of the photoreceptor 101.

The full color toner images transferred onto a recording paper are fixed in a fixing device 118 shown in FIG. 5. The fixing device includes a heating roller 118*a* and a pressing roller 118*b*.

Figure 7:
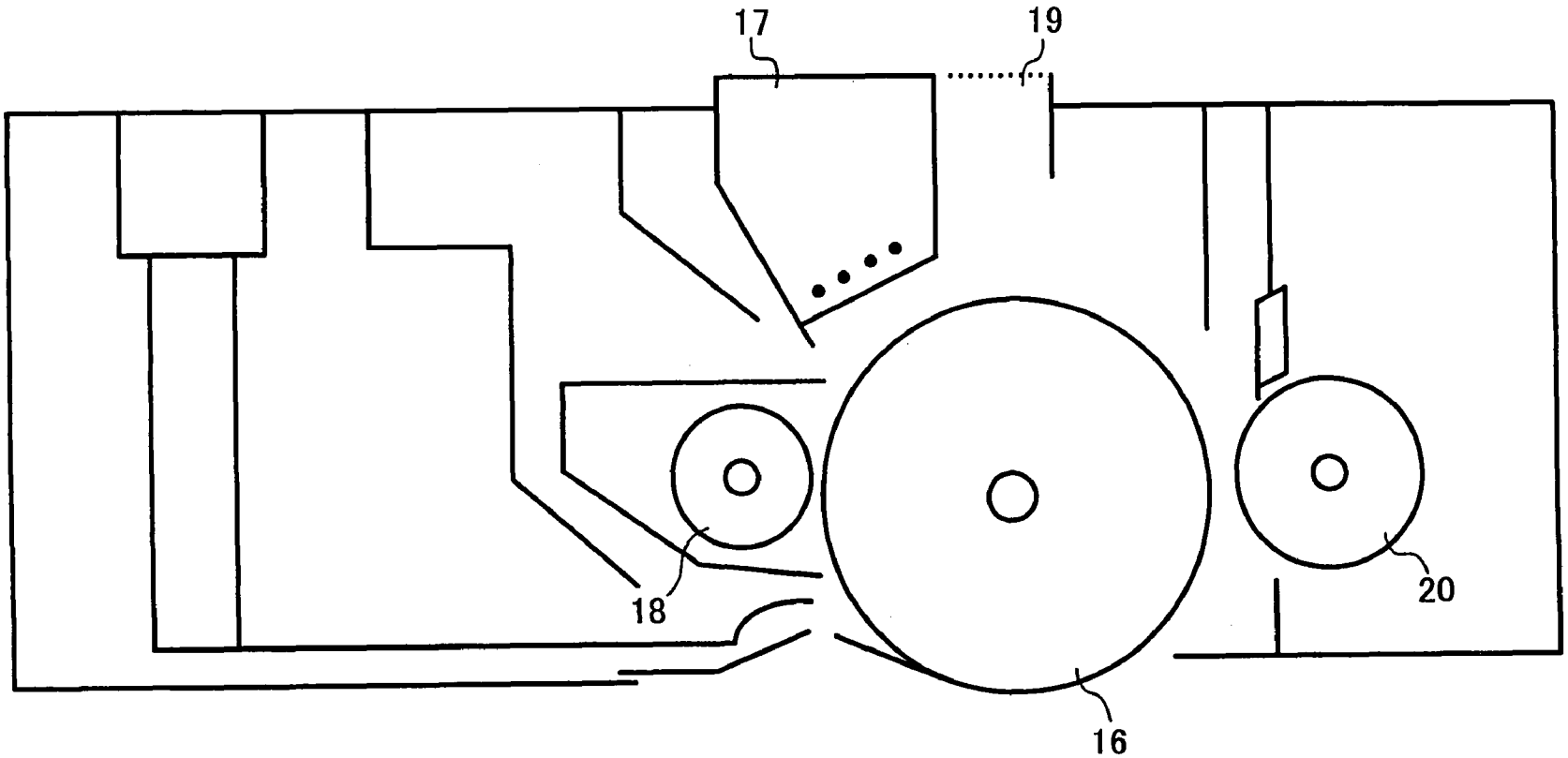
FIG. 7 is a schematic view illustrating another embodiment of the process cartridge of the present invention.

FIG. 7 is a schematic view illustrating another embodiment of the process cartridge of the present invention. A photoreceptor 16 includes an electroconductive substrate and a photosensitive layer overlying on the substrate. The photoreceptor may have a protective layer as an outermost protective layer. In addition, the process cartridge includes a charger 17 as a charging device, a cleaning brush 18 as a cleaning device, a light irradiator 19 as a light irradiating device and a developing roller 20 as a developing device.

Then the toner for use in the image forming apparatus of the present invention will be explained.

The toner in the present invention is prepared by a method including:

dissolving or dispersing a toner constituent mixture including a polymer capable of reacting with an active hydrogen atom, a polyester resin, and the colorant in an organic solvent to prepare a toner constituent mixture liquid; and dispersing the toner constituent mixture liquid in an aqueous medium while subjecting the polymer to at least one of an extension reaction and a crosslinking reaction using a compound having an active hydrogen atom to prepare a dispersion including toner particles in the presence of a particulate resin.

The materials used for the toner and the manufacturing method of the toner will be explained below.

<Polyester>

The polyester resin is formed by polycondensation reaction between a polyol and a polycarboxylic acid.

As the polyol (PO), diols (DIO) and polyols (TO) having three or more valences can be used, and diols (DIO) alone or mixtures of a diol and a small amount of a polyol are preferably used.

Specific examples of diol (DIO) include alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polypropylene glycol and polytetramethylene ether glycol; alicylic diols such as 1,4-cyclohexanedimethanol and hydrogenated bisphenol A; bisphenols such as bisphenol A, bisphenol F and bisphenol S; adducts of the above-mentioned alicyclic diol with an alkylene oxide such as ethylene oxide, propylene oxide and butylenes oxide; and adducts of the above mentioned bisphenol with an alkylene oxide such as ethylene oxide, propylene oxide and butylenes oxide. In particular, an alkylene glycol having 2 to 12 carbon atoms and adducts of bisphenol with an alkylene oxide are preferably used, and a mixture thereof is more preferably used.

Specific examples of the polyols (TO) having three or more valences include multivalent aliphatic alcohols having three or more valences such as glycerin, trimethylolethane, trimethylolpropane, pentaerythritol and sorbitol; phenols having three or more valences such as trisphenol PA, phenolnovolak and cresolnovolak; and adducts of the above-mentioned polyphenol having three or more valences with an alkylene oxide.

As the polycarboxylic acid (PC), dicarboxylic acids (DIC) and polycarboxylic acids (TC) having three or more valences can be used. Dicarboxylic acids (DIC) alone, or mixtures of a dicarboxylic acid and a small amount of a polycarboxylic acid are preferably used.

Specific examples of the dicarboxylic acids (DIC) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used.

Specific examples of the polycarboxylic acid (TC) having three or more valences include aromatic polycarboxylic acids having 9 to 20 carbon atoms such as trimellitic acid and pyromellitic acid.

The polycarboxylic acid (PC) can be formed from a reaction between one or more of the polyols (PO) and an anhydride or lower alkyl ester of one or more of the above-mentioned acids. Suitable lower alkyl esters include, but are not limited to, methyl esters, ethyl esters, and isopropyl esters.

A polyol (PO) and a polycarboxylic acid (PC) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyol (PO) and the polycarboxylic acid (PC) are heated at a temperature of from 150 to 280° C. in the presence of a known catalyst, such as tetrabutoxy titanate or dibutyltinoxide. The water generated by the reaction is removed, under a reduced pressure if desired, to prepare a polyester resin having a hydroxyl group. The polyester resin preferably has a hydroxyl value not less than 5 mg KOH/g. The polyester resin preferably has an acid value of from 1 to 30 mg KOH/g, and more preferably from 5 to 20, such that the resultant toner is negatively charged and has good fixability. When the acid value is greater than 30 mg KOH/g, chargeability of the resultant toner deteriorates, particularly when the toner is used in an environment of high humidity and high temperature.

The polyester resin preferably has a weight-average molecular weight of from 10,000 to 400,000, and more preferably from 20,000 to 200,000. When the weight-average molecular weight is less than 10,000, hot offset resistance of the resultant toner deteriorates. When the weight-average molecular weight is greater than 400,000, low-temperature fixability deteriorates.

In the present invention, an urea-modified polyester is preferably used in combination with the unmodified polyester resin mentioned above.

Specific examples of the urea-modified polyester resin include reaction products of polyester prepolymers (A) having an isocyanate group with amines (B). The polyester prepolymer (A) is formed by reacting the end groups of an unmodified polyester such as carboxyl group and hydroxyl group, with a polyisocyanate (PIC).

Specific examples of the polyisocyanate (PIC) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenediisocyanate and diphenylmethanediisocyanate; aromatic aliphatic diisocyanates such as α, α, α', α'-tetramethylxylylenediisocyanate; isocyanurates; the above-mentioned polyisocyanates blocked with phenol derivatives, oxime and caprolactam; and their combinations.

A polyisocyanate (PIC) is mixed with a polyester such that the equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When the ratio [NCO]/[OH] is too large, low-temperature fixability of the resultant toner deteriorates. When the ratio [NCO]/[OH] is too small, the urea content in the resultant modified polyester decreases and the hot offset resistance of the resultant toner deteriorates.

The content of the constitutional unit obtained from a polyisocyanate in the polyester prepolymer (A) (having a polyisocyanate group at its ends) is from 0.5 to 40% by weight, preferably from 1 to 30% by weight and more preferably from 2 to 20% by weight. When the content is too small, the hot offset resistance of the resultant toner deteriorates, and in addition, the heat resistance and low-temperature fixability of the toner also deteriorate. In contrast, when the content is too large, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the urea-modified polyester decreases and the hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetrametylene diamine and hexamethylene diamine, etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine is mixed with a small amount of polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1/1.5 to 1.5/1 and more preferably from 1/1.2 to 1.2/1. When the mixing ratio is too large or too small, the molecular weight of the urea-modified polyester decreases, resulting in deterioration of hot offset resistance of resultant toner.

The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too small, hot offset resistance of the resultant toner deteriorates.

The urea-modified polyester resin of the present invention can be produced by a method such as a one-shot method. Specifically, a polyol (PO) and a polycarboxylic acid (PC) are heated at a temperature of from 150 to 280° C. in the presence of a known catalyst, such as tetrabutoxy titanate or dibutyltinoxide. The water generated by the reaction is removed, under a reduced pressure if desired, to prepare a polyester resin having a hydroxyl group. The polyester resin is then reacted with a polyisocyanate (PIC) at a temperature of from 40 to 140° C., to prepare a prepolymer (A) having an isocyanate group. Further, the prepolymer (A) is reacted with an amine (B) at a temperature of from 0 to 140° C., to prepare a urea-modified polyester resin.

When a polyisocyanate (PIC) is reacted with a polyester resin, and a polyester prepolymer (A) and an amine (B) are reacted, a solvent can be used if desired. Suitable solvents include solvents which do not react with polyisocyanate (PIC). Specific examples of such solvents include aromatic solvents such as toluene and xylene; ketones such as acetone, methyl ethyl ketone and methyl isobuthyl ketone; esters such as ethyl acetate; amides such as dimethylformamide and dimethylacetoamide; ethers such as tetrahydrofuran.

The molecular weight of the urea-modified polyester can optionally be controlled using an elongation anticatalyst, if desired. Specific examples of the elongation anticatalyst include monoamines such as diethyl amine, dibutyl amine, butyl amine and lauryl amine; and blocked amines, i.e., ketimine compounds prepared by blocking the monoamines mentioned above.

The weight-average molecular weight of the urea-modified polyester resin is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester resin is not particularly limited when the unmodified polyester resin is used in combination. Namely, the weight-average molecular weight of the urea-modified polyester has priority over the number-average molecular weight thereof. However, when the urea-modified polyester resin is used alone, the number-average molecular weight is from 2,000 to 20,000, preferably from 2,000 to 10,000 and more preferably from 2,000 to 8,000. When the number-average molecular weight is too large, the low-temperature fixability of the resultant toner deteriorates, and in addition the glossiness of full color images deteriorates.

In the present invention, it is more preferable to use a unmodified polyester resin in combination with a urea-modified polyester resin than to use the urea-modified polyester resin alone because the low-temperature fixability and glossiness of full color images of the resultant toner improve. The unmodified polyester resin may include a polyester modified with a bond except for a urea bond (i.e. other modifications may be present other than the presence of urea bonding).

It is preferable that the unmodified polyester resin and the urea-modified polyester resin are partially soluble with each other to improve the low-temperature fixability and hot offset resistance of the resultant toner. Therefore, the unmodified polyester resin and the urea-modified polyester resin preferably have similar structures.

A weight ratio between the unmodified polyester resin and the urea-modified polyester resin is from 20/80 to 95/5, preferably from 70/30 to 95/5, more preferably from 75/25 to 95/5, and even more preferably from 80/20 to 93/7. When the weight ratio of the urea-modified polyester resin is too small, the resultant toner has poor hot offset resistance, thermostable preservability and low-temperature fixability.

In the present invention, the binder resin including an unmodified polyester resin and an urea-modified polyester resin preferably has a glass transition temperature (Tg) of from 45 to 65° C. and more preferably from 45 to 60° C. When Tg is too low, the heat resistance of the resultant toner deteriorates. When Tg is too high, the low-temperature fixability of the resultant toner deteriorates.

The urea-modified polyester resin tends to exist on the surface of the resultant mother toner particle. Therefore, the toner has a better high temperature preservability than known polyester toners even though the glass transition temperature of the toner is lower than that of the known polyester toners.

<Colorants>

Specific examples of colorants for use in the present invention include any known dyes and pigments such as carbon black, Nigrosine dyes, black iron oxide, NAPHTHOL YELLOWS, HANSA YELLOW (10G, 5G, G, GR, A, RN and R), Cadmium yellow, yellow iron oxide, loess, chrome yellow, Titan yellow, polyazo yellow, Oil yellow, Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red (4R, F2R, F4R, FRL, FRLL, F4RH, F5R), Para Red, Fire Red, p-chloro-o-nitroaniline red, Lithol Fast Scarlet G, Brilliant Fast Scarlet, Brilliant Carmine 6B, Pigment Scarlet 3B, Bordeaux (5B and 10B), Toluidine Maroon, PERMANENT BORDEAUX F2K, HELIO BORDEAUX BL, BON MAROON LIGHT, BON MAROON MEDIUM, Eosin Lake, Rhodamine Lake B, Phodamine Lake Y, Arizaline Lake, Thioindigo Red B, Thioindigo Maroon, Oil Red, Quinacridone Red, Pyrazolone Red, polyazo red, Chrome Vermilion, Benzidine Orange, perynone orange, Oil orange, cobalt blue, cerulean blue, ALkali Blue Lake, Peacock Blue Lake, Victoria Blue Lake, metal-free Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome green, zinc green, chromium oxide, viridian, emerald green, Pigment Green B, Naphthol Green B, Green Gold, Acid Green Lake, Malachite Green Lake, Phthalocyanine Green, Anthraquione Green, titanium oxide, zinc oxide, lithopone and the like. These materials are used alone or in combination. The toner particles preferably include the colorant in an amount of from 1 to 15% by weight, and more preferably from 3 to 10% by weight.

The colorant for use in the present invention can be used as a master batch pigment, if desired, when combined with a resin. Specific examples of the resin for use in the master batch pigment or for use in combination with master batch pigment include styrene polymers and substituted styrene polymers such as polystyrene, poly-p-chlorostyrene and polyvinyltoluene; styrene-vinyl copolymers; and other resins such as polymethyl methacrylate, polybuthylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins are used alone or in combination.

<Charge Controlling Agent>

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of marketed products of the charge controlling agents include BONTRON 03 (Nigrosine dyes), BONTRON P-51 (quanternary ammonium salt), BONTRON S-34 (metal-containing azo dye), E-82 (metal complex of oxynaphthoic acid), E-84 (metal complex of salicylic acid) and E-89 (phenolic condensation product), which are manufactured by Orient Chemical Industries Co , Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901 and LR-147 (boron complex), which are manufactured by Japan Carlit Co., Ltd.; copper phthalocyanine, perylene, quinacridone, azo pigments and polymers having a functional group such as sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

<Release Agent>

The toner for use in the present invention preferably includes a wax as the release agent. The wax preferably has a melting point of from 50 to 120° C. to work more effectively as a release agent in the interface between the fixing roller and the toner. Thereby the toner has a good hot offset resistance without applying the release agent such as oil to the fixing roller.

Specific examples of the waxes include vegetable waxes such as carnauba wax, cotton wax, haze wax and rice wax; animal waxes such as beeswax and lanoline; mineral waxes such as ozokerite and ceresin; and petroleum waxes such as paraffin, microcrystalline and petrolatum.

Specific examples of the waxes other than the above-mentioned natural waxes include synthetic hydrocarbon waxes such as Fischer-Tropsch wax and polyethylene wax; synthetic waxes such as ester, ketone and ether.

In addition, fatty acid amides such as 12-hydroxystearic acid amide, stearic acid amide, phthalic anhydride imide and chlorinated hydrocarbon; crystalline polymers having long alkyl side chains such as homopolymers and copolymers of polyacrylate, i.e., low-molecular-weight crystalline polymer resin, such as poly-n-stearylmethacrylate and poly-n-laurylmethacrylate (for example, copolymer of n-stearylacrylate and ethylmethacrylate); can be used.

The charge controlling agent and release agent can be kneaded upon application of heat together with a master batch pigment and a resin, or can be added to toner constituents when the toner constituents are dissolved and dispersed in an organic solvent.

In the present invention, the low-melting point wax particles dispersed in the toner preferably have such particle size distribution that wax particles having a dispersion diameter of from 0.1 to 1 μm accounts for at least 70% by number of the wax particles. When the amount of such small wax particle is too small, i.e., wax particles having a dispersion diameter of less than 0.1 μm are included in a large amount, satisfactory releasability cannot be attained and hot offset tends to occur. In contrast, when the amount of such small wax particle is too large, i.e., wax particles having a dispersion diameter of greater than 1 μm are included in a large amount, wax particles tend to exit on the surface of toner particles and thereby a toner film is formed on the photoreceptor or other image forming members.

<External Additive>

In the present invention, an external additive having an appropriate characteristic preferably exists on the surface of the toner to form a gap between the toner and the objects such as photoreceptors. Because the external additive is uniformly contacted with the toner particles, the photoreceptor and the charging member while having a small contact area, the adherence of the toner to the photoreceptor and charging member can be decreased, and the developing efficiency and the transfer efficiency of the toner can also be improved. In addition, the external additive plays a role as a roller bearing, the photoreceptor is not abraded and damaged. Moreover, the external additive particle is hardly embedded into the toner particles even when a high stress is applied to the photoreceptor by the cleaning blade. Even if the external additive is slightly embedded to the toner particle, the external additive can recover. Therefore, a stable cleanability can be imparted to the toner for a long period. Furthermore, the external additive particle moderately leaves from the surface of the toner and is adhered to the edge of the cleaning blade, resulting in function of a dam. The dam has an effect on avoiding the phenomenon in that the toner passes through the cleaning blade.

The external additive particle mentioned above decreases the shear applied to the toner, and thereby formation of a film of the toner on the photoreceptor, etc., which is caused by the low-rheological components included in the toner, in a high-speed fixation (low-energy fixation) can be prevented. In addition, external additive particles having an average primary particle diameter of from 50 to 500 nm improve the cleaning property of the resultant toner without decreasing the fluidity of the resultant toner. The reason is not certain, but is considered as follows. When a surface-treated external additive particle is added to the toner, the deterioration level of the developer is low even if the external additive particle contaminates the carrier.

The external additive preferably has an average primary particle diameter of from 50 to 500 nm, and preferably from 100 to 400 nm. When the average primary particle diameter is less than 50 nm, the external additive particle tends to be buried in the concavity of the toner surface and deteriorates the role of the roller bearing. In contrast, when the average primary particle diameter is larger than 500 nm, the defective cleaning problem in that the toner passes through the blade occurs. This is because the external additive has a particle diameter on the order of that of the toner, and toner particles passes through the gap formed between the cleaning blade and the photoreceptor by the external additive.

The apparent density of the external additive particle is preferably not less than 30 mg/cm$^3$. When the apparent density is too small, the fluidity of the toner improves, but the resultant toner and the external additive are easily scattered and the adherence thereof to the photoreceptor, etc. is increased. Therefore, the dam effect deteriorates, resulting in occurrence of defective cleaning.

Specific examples of inorganic particles for use as the external additive include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)n$, $Al_2O_3.2SiO_2$, $CaCO_3$, $MgCO_3$, $BaSO_4$, $MgSO_4$, $SrTiO_3$, etc. Among these, $SiO_2$, $TiO_2$ and $Al_2O_3$ are preferably used. These inorganic compounds may be treated by a surface treatment agent such as coupling agents, hexamethyldisilazane, dimethyldichlorosilane, and octyltrimethoxysilane.

Specific examples of organic particles for use as the external additive include thermoplastic resins and thermosetting resins, such as vinyl resins, polyurethane resins, epoxy resins, polyester resins, polyamide resins, polyimide resins, silicone resins, phenol resins, melamine resins, urea resins, aniline resins, ionomer resins, polycarbonate resins, etc. These resins may be used in combination. In order to easily make a water dispersion of fine resin particles, vinyl resins, polyurethane resins, epoxy resins, polyester resins and these combinations are preferably used.

Specific examples of the vinyl resins for use as the external additive include polymers formed from a polymerization reaction or a copolymerization reaction of vinyl monomer such as styrene-methacrylate copolymers, styrene-butadiene copolymers, methacrylic acid-methacrylate copolymers, styrene-acrylonitrile copolymers, styrene-maleic anhydride copolymers, styrene-methacrylic acid copolymer, etc.

In the present invention, the external additive particles are typically added to the toner by a method including; mechanically mixing mother toner particles and an external additive by a known mixing device; or a method including dispersing the mother toner particles and the external additive in a liquid using a surfactant to adhere to, and drying.

<Average Circularity>

The toner of the present invention preferably has an average circularity of from 0.93 to 0.99 and more preferably from 0.94 to 0.99. The circularity of a particle is determined by the following equation (3):

$$C=Lo/L \quad (3)$$

wherein C represents the circularity, Lo represents the length of the circumference of a circle having the same area as that of the image of the particle and L represents the peripheral length of the image of the particle. The circularity indicates the irregularity of the toner particle. When the toner is completely spherical, C is 1.00. When the toner shape becomes more complex, the circularity decreases.

When the toner for use in the present invention has the average circularity of from 0.93 to 0.99, the resultant toner has a smooth surface and the touch area of the toner particles with the photoreceptor decreases, and thereby the transfer efficiency can be improved.

In addition, since such a toner has no sharp edges, the torque agitating the developer in the developing device can be decreased. Therefore, the agitator can be stably driven and formation of abnormal images can be prevented.

In a transfer process, such a toner with no sharp edges receives a pressure uniformly from the transfer member, and thereby defective transferring is not caused and high definition images can be produced.

Further, since such a toner with no sharp edges has a small abrasive force, the surfaces of the photoreceptor and charging member are not damaged and abraded.

The average circularity of the toner can be determined by a flow-type particle image analyzer, FPIA-1000 manufactured by Sysmex Corp.

Specifically, the method is as follows:

(1) 0.1 g to 0.5 g of a sample to be measured is mixed with 100 ml to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per micro-liter of the suspension; and (3) the average circularity and circularity distribution of the sample in the suspension are determined by the measuring instrument mentioned above.

The toner for use in the present invention preferably has a weight average particle diameter of from 2.5 to 6.5 μm.

<Method for Manufacturing the Toner>

Next, the method for manufacturing the toner for use in the present invention will be explained. The toner is preferably prepared by the following method, but is not limited thereto.

(1) At first, a colorant, an unmodified polyester resin, a polyester prepolymer having isocyanate groups and a release agent are dissolved or dispersed in a volatile organic solvent to prepare a toner constituent mixture liquid.

The volatile solvents preferably have a boiling point lower than 100° C. so as to be easily removed after the granulating process. Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and metyl isobuthyl ketone. These solvents can be used alone or in combination. In particular, aromatic solvents such as toluene and xylene, and halogenated hydrocarbons such as metylene chloride, 1,2-dichloroethane, chloroform and carbon tetrachloride are preferably used. The added amount of the organic solvent is generally from 0 to 300 parts, preferably from 0 to 100 parts and more preferably 25 to 70 parts by weight, per 100 parts by weight of the polyester prepolymer.

(2) The thus prepared toner constituent mixture liquid is emulsified in an aqueous medium in the presence of a surfactant and a particulate resin.

Suitable aqueous media include water. In addition, other solvents which can be mixed with water can be added to water. Specific examples of such solvents include alcohols such as methanol, isopropanol and ethylene glycol; dimethylformamide, tetrahydrofuran, cellosolves such as methyl cellosolve, lower ketones such as acetone and methyl ethyl ketone, etc. The content of the aqueous medium to 100 parts by weight of the toner constituent mixture liquid is typically from 50 to 2,000 parts by weight, and preferably from 100 to 1,000 parts by weight. When the content is less than 50 parts by weight, the particulate organic material tends not to be well dispersed, and thereby a toner having a desired particle diameter cannot be prepared. In contrast, when the content is greater than 2,000 parts by weight, the production costs increase.

When the toner constituent mixture liquid is emulsified in an aqueous medium, dispersants such as surfactants and resin particles, are preferably used.

Specific examples of the surfactants include anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives and imidadoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride) ; nonionic surfactants such as fatty acid amine derivatives, polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl (C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkyl(C7-C13)carboxylic acids and their metal salts, perfluoroalkyl (C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonylglycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.,; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants having a fluoroalkyl group include primary, secondary and tertiary aliphatic amines having a fluoroalkyl group, aliphatic quaternary salts such as perfluoroalkyl(C6-C10) sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

The resin particles mentioned above are added to stabilize the dispersion of the toner mother particle in an aqueous medium. Therefore, the coverage of the surface of the mother toner particle by the resin particles is preferably from 10 to 90%.

Specific examples of the resin particles include polymethyl methacrylate particles having an average particle diameter of 1 μm or 3 μm, polystyrene particles having an average particle diameter of 0.5 μm or 2 μm, and poly(styrene-acrylonitrile) having an average particle diameter of 1 μm. Specific examples of the marketed products thereof include PB-200H (from Kao Corporation), SGP and SGP-3G (from Sohken Chemical Engineering Co., Ltd.), TECHPOLYMER-SB (from Sekisui Plastics Co., Ltd.), MICRO-PEARL (from Sekisui Chemical Co., Ltd.), etc. In addition, inorganic dispersants such as tricalcium phosphate, calcium carbonate, titanium oxide, colloidal silica and hydroxyapatite can also be used.

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine) In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

As the dispersing machine, known mixers and dispersing machines such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is generally 0 to 150° C. (under pressure), and preferably from 40 to 98° C.

(3) An amine (B) is added to be reacted with the polyester prepolymer (A) having isocyanate groups at the time of the emulsification.

This reaction is a crosslinking reaction and/or an elongation reaction of polymer chains. The reaction time of the particles are determined depending on the reactivity of the isocyanate of the prepolymer (A) used with the amine used. However, the reaction time is typically from 10 minutes to 40 hours, and preferably from 2 to 20 hours. The reaction temperature is typically from 0 to 150° C. and preferably from 40 to 98° C. In addition, known catalysts such as dibutyl tin laurate and dioctyl tin laurate can be added, if desired, when the reaction is performed.

(4) After the reaction, the organic solvent is removed from the emulsion (i.e., reaction product), and the reaction product is washed and dried to get the mother toner particle.

In order to prepare a spindle-shape toner particle, the emulsion is gradually heated under a laminar agitating, and then a strong shear is applied to the emulsion in a certain temperature range before removing the solvent. When compounds soluble to both acids and bases, such as calcium phosphate salts, are used as a dispersant, it is preferable that calcium phosphate is dissolved by acids such as hydrochloric acid, followed by washing with water. Enzymes are also usable to remove the dispersant.

(5) The thus prepared mother toner particles are mixed with a charge controlling agent, and the mixture is mixed with inorganic particles such as silica and titanium oxide, by the known methods such as using a mixer.

The toner having a small diameter and a narrow particle diameter distribution is easily manufactured by the method mentioned above. In addition, the toner shape can be easilly controlled so as to be from a spherical form to a spindle form by applying a high shear in the solvent removal process. Moreover, the toner surface condition can also be controlled so as to be smooth or rough.

Then the photoreceptor of the present invention will be explained in detail referring to drawings.

Figure 8:
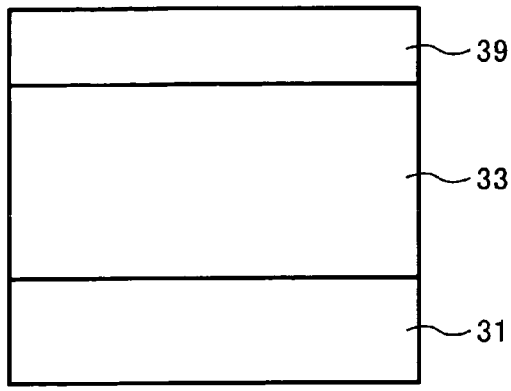
FIGS. 8 to 13 are schematic views illustrating cross-sections of embodiments of the photoreceptor of the present invention.

FIG. 8 is a cross section of an example of the photoreceptor of the present invention. The photoreceptor has an electroconductive substrate 31, and a photosensitive layer 33 including a charge generation material and a charge transport material as main components, and a protective layer 39, wherein the layers 33 and 39 are overlaid on the electroconductive substrate 31 in this order.

Figure 9:
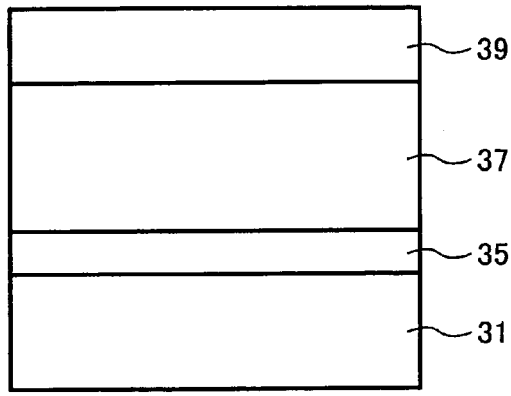

FIG. 9 is a cross section of another example of the photoreceptor of the present invention. The photoreceptor has an electroconductive substrate 31, a charge generation layer 35 including a charge generation material as a main component, a charge transport layer 37 including a charge transport material as a main component, and a protective layer 39, wherein the layers 35, 37 and 39 are overlaid on the electroconductive substrate 31 in this order. The charge generation layer 35 and the charge transport layer 37 configure a photosensitive layer.

Figure 10:
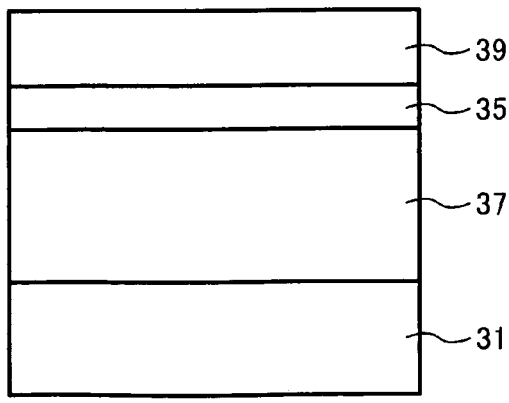

FIG. 10 is a cross section of yet another example of the photoreceptor of the present invention. The photoreceptor has an electroconductive substrate 31, a charge transport layer 37 including a charge transport material as a main component, a charge generation layer 35 including a charge generation material as a main component, and a protective layer 39, wherein the layers 37, 35 and 39 are overlaid on the electroconductive substrate 31 in this order. The charge transport layer 37 and the charge generation layer 35 configure a photosensitive layer.

Figure 11:
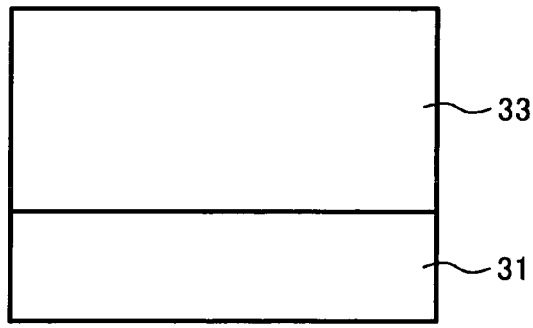
Figure 12:
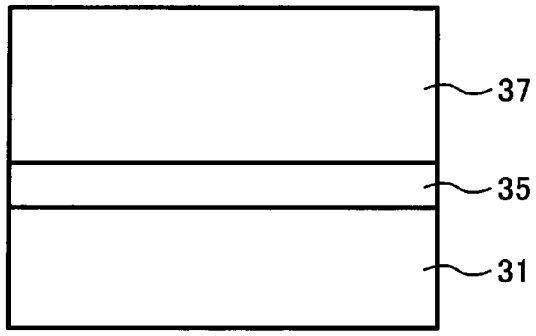
Figure 13:
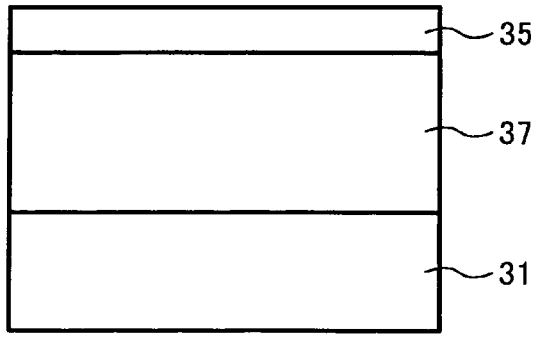

FIGS. 11 to 13 are cross sections of other examples of the photoreceptor of the present invention. The outermost layers of the photoreceptors shown in FIGS. 11 to 13 are the photosensitive layers while the outermost layers of the photoreceptors shown in FIGS. 8 to 10 are the protective layers. Namely, in the present invention, both the photosensitive layer and the protective layer can be the outermost layer.

Suitable materials for use as the electroconductive substrate 31 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like can also be used as the substrate 31.

Furthermore, substrates, in which a coating liquid including a binder resin and an electroconductive powder is coated on the supports mentioned above, can be used as the substrate 31. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 31.

Then the photosensitive layer will be explained. The photosensitive layer may be a single-layered photosensitive layer including a charge generation material and a charge transport material, or a multi-layered photosensitive layer including the charge generation layer and the charge transport layer. At first, the multi-layered photosensitive layer including the charge generation layer 35 and the charge transport layer 37 will be explained.

The charge generation layer 35 includes a charge generation material as a main component. Specific examples of the charge generation materials include known charge generation materials such as monoazo dyes, disazo dyes, trisazo dyes, perylene pigments, perinone pigments, quinacridone pigments, quinone condensate polycyclic compounds, squalic acid dyes, other phthalocyanine pigments, naphthalocyanine pigments, azulenium salt dyes, etc. These can be used alone or in combination.

The charge generation layer 35 is typically prepared by coating a coating liquid, which is prepared by dispersing the charge generation materal in a solvent, optionally together with a binder resin, using a ball mill, an attritor, a sand mill or an ultrasonic dispersion machine, followed by drying.

Specific examples of the binder resins, which are optionally included in the charge generation layer coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the charge generation layer is preferably from 0 to 500 parts by weight, and more preferably from 10 to 300 parts by weight, per 100 parts by weight of the charge generation material included in the layer. The binder resin may be added before dispersing or after dispersing.

Specific examples of the solvents for use in the charge generation layer coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketones, esters and ethers are preferably used. These solvents can be used alone or in combination.

The charge generation layer 35 includes a charge generation material, a solvent and a binder resin as main components, and every additives such as sensitizers, dispersants, surfactants and silicone oils can be included.

Suitable coating methods include dip coating, spray coating, bead coating, nozzle coating, spinner coating and ring coating.

The charge generation layer 35 preferably has a thickness of from 0.01 to 5 μm, and more preferably from 0.1 to 2 μm.

Next, the charge transport layer 37 will be explained.

The charge transport layer 37 is typically prepared by coating a coating liquid, which is prepared by dissolving or dispersing a charge transport material in a solvent optionally together with a binder resin, followed by drying. If desired, additives such as plasticizers, leveling agents and antioxidants can be added to the coating liquid.

Charge transport materials are classified into electron transport materials and positive-hole transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-vinylcarbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These charge transport materials can be used alone or in combination.

Specific examples of the binder resin for use in the charge transport layer include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like. However, in case the charge transport layer is the outermost layer, after-mentioned binder resins for the protective layer 39 can be used.

The content of the charge transport material in the charge transport layer is preferably from 20 to 300 parts by weight, and more preferably from 40 to 150 parts by weight, per 100 parts by weight of the binder resin included in the charge transport layer. The thickness of the charge transport layer 37 is preferably not greater than 25 μm from the viewpoint of the resolution and the response. Moreover, the thickness of the charge transport layer 37 is preferably not less than 5 μm, but it depends on the system (particularly a charge potential).

Suitable solvents for use in the charge transport layer coating liquid include tetrahydrofuran, dioxane, toluene, dichloromethane, monochlorobenzene, dichloroethane, cyclohexanone, methyl ethyl ketone, acetone and the like solvents. These solvents can be used alone or in combination.

Charge transport polymers, which have both a binder resin function and a charge transport function, can be preferably used for the charge transport layer because the resultant charge transport layer has good abrasion resistance.

Suitable charge transport polymers include known charge transport polymer materials. Among these materials, polycarbonate resins having a triarylamine group in their main chain and/or side chain are preferably used. In particular, charge transport polymers having the following formulae of from (i) to (x) are preferably used:

(i)

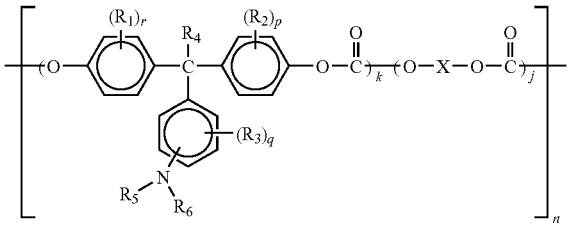

wherein $R_1$, $R_2$ and $R_3$ each, independently, represent a substituted or unsubstituted alkyl group, or a halogen atom; $R_4$ represents a hydrogen atom, or a substituted or unsubstituted alkyl group; $R_5$, and $R_6$ each, independently, represent a substituted or unsubstituted aryl group; r, p and q each, independently, represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

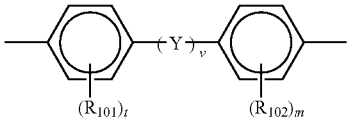

wherein $R_{101}$ and $R_{102}$ each, independently, represent a substituted or unsubstituted alkyl group, a substituted or unsubstituted aryl group, or a halogen atom; t and m each, independently, represent 0 or an integer of from 1 to 4; v is 0 or 1; and Y represents a linear or a branched or a cyclic alkylene group having carbon atoms in number of from 1 to 12, —O—, —S—, —SO—, —$SO_2$—, —CO—, —CO—O—Z—O—CO— (Z represents a divalent aliphatic group), or a group having the following formula:

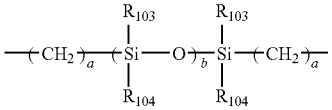

wherein a is an integer of from 1 to 20; b is an integer of from 1 to 2000; and $R_{103}$ and $R_{104}$ each, independently, represent a substituted or unsubstituted alkyl group, or a substituted or unsubstituted aryl group, wherein $R_{101}$, $R_{102}$, $R_{103}$ and $R_{104}$ may be the same or different from the others;

(ii)

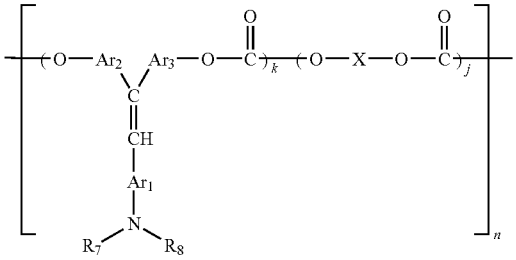

wherein $R_7$ and $R_8$ each, independently, represent a substituted or unsubstituted aryl group; $Ar_1$, $Ar_2$ and $Ar_3$ each, independently, represent an arylene group; and X, k, j and n are as defined above in formula (i);

(iii)

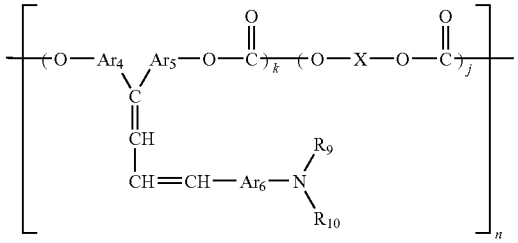

wherein $R_9$ and $R_{10}$ each, independently, represent a substituted or unsubstituted aryl group; $Ar_4$, $Ar_5$ and $Ar_6$ each, independently, represent an arylene group; and X, k, j and n are as defined above in formula (i);

(iv)

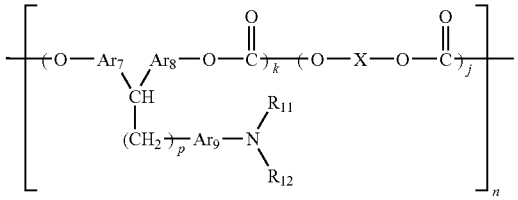

wherein $R_{11}$ and $R_{12}$ each, independently, represent a substituted or unsubstituted aryl group; $Ar_7$, $Ar_8$ and $Ar_9$ each, independently, represent an arylene group; p is an integer of from 1 to 5; and X, k, j and n are as defined above in formula (i);

(v)

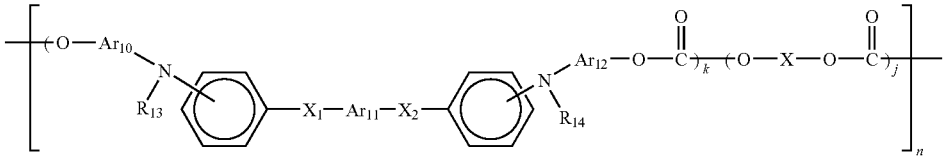

wherein $R_{13}$ and $R_{14}$ each, independently, represent a substituted or unsubstituted aryl group; $Ar_{10}$, $Ar_{11}$, and $Ar_{12}$ each, independently, represent an arylene group; X1 and $X_2$ each, independently, represent a substituted or unsubstituted ethylene group, or a substituted or unsubstituted vinylene group; and X, k, j and n are as defined above in formula (i);

(vi)

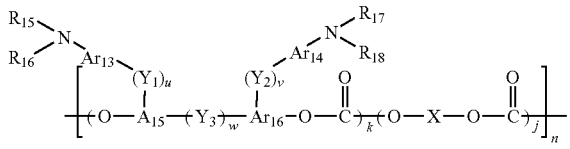

wherein $R_{15}$, $R_{16}$, $R_{17}$ and $R_{18}$ each, independently, represent a substituted or unsubstituted aryl group; $Ar_{13}$, $Ar_{14}$, $Ar_{15}$ and $Ar_{16}$ each, independently, represent an arylene group; $Y_1$, $Y_2$ and $Y_3$ each, independently, represent a substituted or unsubstituted alkylene group, a substituted or unsubstituted cycloalkylene group, a substituted or unsubstituted alkyleneether group, an oxygen atom, a sulfur atom, or a vinylene group; u, v and w each, independently, represent 0 or 1; and X, k, j and n are as defined above in formula (i);

(vii)

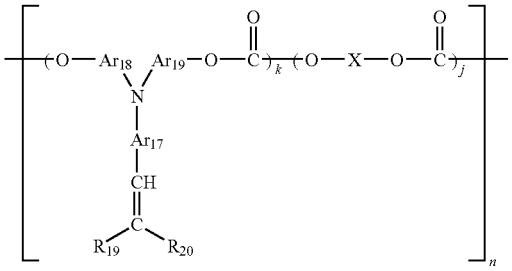

wherein $R_{19}$ and $R_{20}$ each, independently, represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ each, independently, represent an arylene group; and X, k, j and n are as defined above in formula (i);

(viii)

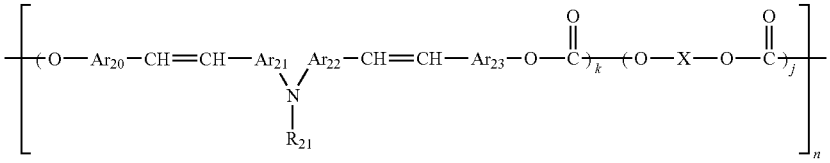

wherein $R_{21}$ represents a substituted or unsubstituted aryl group; $Ar_{20}$, $Ar_{21}$, $Ar_{22}$ and $Ar_{23}$ each, independently, represent an arylene group; and X, k, j and n are as defined above in formula (i);

(ix)

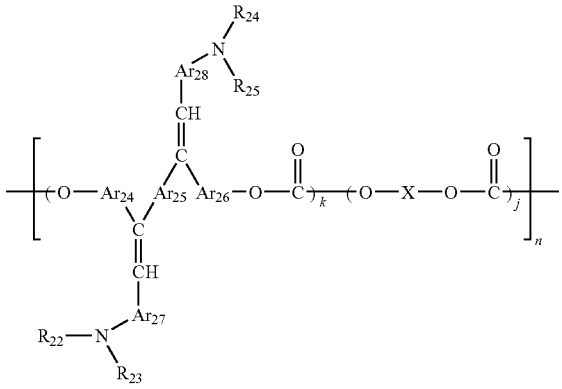

wherein $R_{22}$, $R_{23}$, $R_{24}$ and $R_{25}$ each, independently, represent a substituted or unsubstituted aryl group; $Ar_{24}$, $Ar_{25}$, $Ar_{26}$, $Ar_{27}$ and $Ar_{28}$ each, independently, represent an arylene group; and X, k, j and n are as defined above in formula (i);

(x)

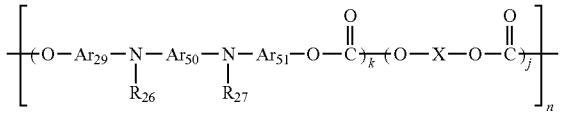

wherein $R_{26}$ and $R_{27}$ each, independently, represent a substituted or unsubstituted aryl group; $Ar_{29}$, $Ar_{30}$ and $Ar_{31}$ each, independently, represent an arylene group; and X, k, j and n are as defined above in formula (i).

Suitable coating methods include dip coating, spray coating, bead coating, nozzle coating, spinner coating and ring coating.

Next, the single-layered photosensitive layer 33 will be explained. In this case, the photosensitive layer 33 includes at least a charge generation material and a binder resin. The charge generation layer 33 is typically prepared by coating a coating liquid, which is prepared by dispersing the charge generation material, the charge transport material and the binder resin in a solvent, followed by drying. If desired, additives such as plasticizers, leveling agents and antioxidants can be added to the coating liquid.

Suitable materials for use as the binder resin include the materials mentioned above for use as the binder resin in the charge generation layer 35 and the charge transport layer 37.

In addition, the charge transport polymers mentioned above can also be preferably used for the single-layered photosensitive layer. The content of the charge generation material is preferably from 5 to 40 parts by weight, the content of the charge transport material is preferably from 0 to 190 parts by weight, more preferably from 50 to 150 parts by weight per 100 parts by weight of the binder resin included in the layer. The photosensitive layer is typically prepared by coating a coating liquid, which is prepared by dissolving or dispersing a charge generation material, a binder resin and optionally together with a charge transport material in a solvent such as tetrahydrofuran, dioxane, dichloroethane, cyclohexane, etc. Suitable coating methods include dip coating, spray coating, bead coating, ring coating, etc. The thickness of the photosensitive layer is preferably from 5 to 25 μm.

The photoreceptor in the present invention can include an undercoat layer between the electroconductive substrate 31 and the photosensitive layer. Since the photosensitive layer is typically formed on the undercoat layer by a wet coating method, the undercoat layer preferably has a good resistance to the solvents included in the coating liquids of the photosensitive layer. Suitable resins for use in the undercoat layer include water-soluble resins such as polyvinyl alcohols, caseins, sodium polyacrylic acids; alcohol-soluble resins such as copolymer nylons and methoxymethyl nylons; thermosetting resins forming a three-dimensional network structure such as polyurethane, melamine resins, phenol resins, alkyd-melamine resins and epoxy resins. In addition, to prevent occurrence of moiré and to decrease the residual potential, the undercoat layer can include fine powder pigments of metal oxides such as titanium oxide, silica, alumina, zirconium oxide, tin oxide, indium oxide, etc.

The undercoat layer can be prepared by the coating methods mentioned above for use in preparing the photosensitive layer. In addition, the undercoat layer can include silane coupling agents, titanium coupling agents, chromium coupling agents, etc. Moreover, $Al_2O_3$ layer formed by anodization, and thin films of organic compounds such as poly-para-xylylene (parylene) and inorganic compounds such as $SiO_2$, $SnO_2$, $TiO_2$, ITO and $CeO_2$ formed by a vacuum process, can be used for the undercoat layer. Other known materials can be used. The thickness of the undercoat layer is preferably from 0 to 5 μm.

In the photoreceptor of the present invention, a protective layer 39 is optionally formed on the photosensitive layer to protect the photosensitive layer. By forming a protective layer on the photosensitive layer, the resultant photoreceptor has good durability while having a high sensitivity and producing images without abnormal images.

In the present invention, the outermost layer of the photoreceptor includes at least a binder resin having the following relationship (1):

$$2 \leqq (T_0 - T_{400})/C \quad (1)$$

wherein $T_0$ represents the primary transmittance (%) at 400 nm of a solution of the binder resin, $T_{400}$ represents a transmittance (%) at 400 nm of the solution of the binder resin after the solution is left at rest for 400 hours at 23° C. and 40% RH, and C represents the concentration by weight (%) of the solution in the binder resin. In this regard, "the solution of the binder resin" represents a solution in which the binder resin is dissolved in a solvent, which is used for the outermost layer coating liquid, such as tetrahydrofuran, toluene, dichloroethane, methyl ethyl ketone and cyclohexanone. The concentration C is preferably from 0.1 to 30% by weight, and more preferably the same as that of the outermost layer coating liquid. The formula (1) is used for evaluating the property of the binder resin used for the outermost layer of the photoreceptor. Although the mechanism is not yet determined, an image forming apparatus including a photoreceptor including a binder resin which satisfies formula (1) has a good cleanability. When the binder resin does not satisfy formula (1), in other words, $(T_0-T_{400})/C$ is less than 2, the image forming apparatus has poor cleanability because the toner particles tend to slip through the cleaning blade.

It is preferable that the binder resin included in the outermost layer is not bulky, and has a highly oriented chemical structure. Resins having a bisphenol skelton are preferably used therefore, and in particular, polyarylate resins are more preferably used. These are used alone or in combination with other known resins. Specific examples of the resins include thermoplastic resins and thermosetting resins such as polystyrene resins, styrene-acrylonitrile copolymers, styrene-butadiene copolymers, polyester resins, polyarylate resins, polycarbonate resins, acryl resins, epoxy resins, melamine resins, phenol resins, etc.

In another photoreceptor of the present invention, the outermost layer of the photoreceptor includes at least both a polycarbonate resin and a polyester resin. As mentioned above, when a charge transport layer is formed as the outermost layer, a polycarbonate resin and a polyester resin are included in the charge transport layer.

The polycarbonate resin preferably satisfies the following relationship (2):

$$2 \leqq (T_0 - T_{400})/C \leqq 3 \quad (2)$$

wherein $T_0$ represents the primary transmittance (%) at 400 nm of a solution of the binder resin, $T_{400}$ represents a transmittance (%) at 400 nm of the solution of the binder resin after the solution is left at rest for 400 hours at 23° C. and 40% RH, and C represents the concentration by weight (%) of the solution in the binder resin. In this regard, "the solution of the binder resin" represents a solution in which the polycarbonate resin is dissolved in a solvent, which is used for the outermost layer coating liquid such as tetrahydrofuran, toluene, dichloroethane, methyl ethyl ketone and cyclohexanone. The concentration C is preferably from 0.1 to 30% by weight, and more preferably the same as that of the outermost layer coating liquid. The formula (2) is used for evaluating the property of the polycarbonate resin used for the outermost layer of the photoreceptor. Although the mechanism is not yet determined, an image forming apparatus including a photoreceptor including a polycarbonate resin which satisfies formula (2) has a good cleanability. When the binder resin does not satisfy formula (2), in other words, $(T_0-T_{400})/C$ is less than 2, the image forming apparatus has poor cleanability because the toner particles tend to slip through the cleaning blade.

The polycarbonate resin mentioned above for use in the outermost layer is prepared by known methods.

The weight average molecular weight of the polycarbonate resin is preferably from 10,000 to 200,000.

The polyester resin is a crystalline polyester having at least a detectable level of crystallinity, which is determined by an x-ray diffraction method. The crystalline polyester resin has a crystal structure. Whether a resin has crystallinity can be determined by checking the diffraction peaks of the X-ray diffraction spectrum. In particular, a crystalline polyester has an X-ray diffraction spectrum such that at least one diffraction peak exists in a 2θ angle range of from 20° to 25°, and more preferably diffraction peaks exist at least in each of 2θ angle ranges of from 19° to 20°, from 21° to 22°, from 23° to 25° and from 29° to 31°.

Crystalline polyester resins are preferably synthesized using at least one alcoholic component such as diol compounds having from 2 to 6 carbon atoms, which preferably includes 1,4-butanediol, 1,6-hexanediol and their derivatives in an amount of not less than 80% by mole, preferably from 85 to 100% by mole, and at least one acid component such as fumaric acid, carboxylic acids having a carbon-carbon double bond (such as maleic acid and succinic acid) and derivatives of these acids. The crystalline polyester resin for use in the outermost layer preferably has the following formula (III) in the main molecular chain:

$$[—O—CO—(CR_1{=}CR_2)_k—CO—O—(CH_2)_n—]_m \quad \text{(III)}$$

wherein $R_1$ and $R_2$ each, independently, represent a hydrogen atom or a hydrocarbon group; k, m and n each, independently, represent the number of repeating units.

In order to control the crystallinity of the crystalline polyester resin, a polyol having three or more valences such as glycerine as an alcoholic component and a polycarboxylic acid having three or more valences such as trimellitic anhydride as an acid component can be added when the polyester resin is synthesized. In this case, a non-linear polyester resin is prepared.

Whether or not the molecular structure of (III) exists can be determined using NMR (nuclear magnetic resonance), X-ray diffraction, GC/MS (gas chromatography/mass spectrometry), LC/MS (liquid chromatography/mass spectrometry), IR (infrared spectrophotometry), etc. An easy method is to measure the infrared absorption spectrum of a polyester resin to determine whether an absorption peak is observed at a wave number in a range of from 955 to 975 $cm^{-1}$ or from 980 to 1000 $cm^{-1}$, wherein the peak is caused by out-of-plane bending vibration of olefin.

In the present invention, the infrared absorption spectrum of the polyester resin is measured by transmission Fourier-transform infrared spectrophotometry using MAGNA 850 manufactured by Nicolet Instrument Corporation. KBr (potassium bromide) is used as a standard sample. The spectrum is measured in a wave number range of from 4000 to 400 $cm^{-1}$ and compared to that of the standard sample to estimate the molecular structure of the polyester resin.

The weight average molecular weight of the crystalline polyester resins included in the outermost layer is preferably from 1,000 to 10,000.

When the protective layer 39 is formed as the outermost layer, the protective layer can include other known resins in combination with the polycarbonate resin and the crystalline polyester resin. Specific examples of the resin for use in the protective layer 39 include ABS resins, ACS resins, olefin-vinyl monomer copolymers, chlorinated polyether, aryl resins, phenolic resins, polyacetal, polyamide, polyamideimide, polyallysulfone, polybutylene, polybutyleneterephthalate, polyethersulfone, polyethylene, polyimide, acrylic resins, polymethylpentene, polypropylene, polyphenyleneoxide, polysulfone, polystyrene, polyarylate, AS resins, butadiene-styrene copolymers, polyurethane, polyvinyl chloride, polyvinylidene chloride, epoxy resins, etc.

In addition, in order to impart good abrasion resistance to the protective layer, fillers can be added. Both organic fillers and inorganic fillers can be used. In view of hardness, the inorganic fillers are preferably used to improve abrasion resistance. Specific examples of the inorganic fillers include powders of metals such as copper, tin, aluminum and indium; metal oxides such as silica, tin oxide, zinc oxide, titanium oxide, alumina, zirconia, indium oxide, antimony oxide, bismuth oxide, calcium oxide, tin oxide doped with antimony, indium oxide doped with tin; metal fluorides such as tin fluoride, calcium fluoride, aluminum fluoride; potassium titanate; boron nitride; etc.

The fillers to be included in the protective layer are preferably subjected to a surface treatment using a surface treatment agent in order to improve the dispersion of the fillers in the protective layer. When a filler is poorly dispersed in the protective layer, the following problems occur.

(1) the residual potential of the resultant photoreceptor increases;

(2) the transparency of the resultant protective layer decreases;

(3) coating defects are formed in the resultant protective layer;

(4) the abrasion resistance of the protective layer deteriorates;

(5) the durability of the resultant photoreceptor deteriorates; and (6) the image qualities of the images produced by the resultant photoreceptor deteriorate.

Suitable surface treatment agents include known surface treatment agents. However, surface treatment agents which can maintain the highly insulative property of fillers used are preferably used. As the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination. When fillers treated with a silane coupling agent are used, the resultant photoreceptor tends to produce blurred images. However, combinations of a silane coupling agent with one of the surface treatment agents mentioned above can often produce good images without blurring. The coating weight of the surface treatment agents is preferably from 3 to 30% by weight, and more preferably from 5 to 20% by weight, based on the weight of the treated filler although the weight is determined depending on the average primary particle diameter of the filler. When the content of the surface treatment agent is too low, the dispersibility of the filler cannot be improved. In contrast, when the content is too high, the residual potential of the resultant photoreceptor seriously increases.

In addition, in order to decrease the friction factor of the surface of the photoreceptor to improve the cleaning property thereof, solid lubricants such as fluorocarbon resin particles can be added in the protective layer 39. Specific examples of fluorocarbon resins include polytetrafluoroethylene, polychlorotrifluoroethylene, poly vinylidene fluoride, polytrifluorochloroethylene, dichlorodifluoroethylene, tetrafluoroethylene-ethylene copolymer, tetrafluoroethylene-oxyfluoropropylene copolymer, etc. Poly vinylidene fluoride and polytetrafluoroethylene having low molecular weight of not greater than several hundred thousands are preferably used. Such low molecular weight fluorocarbon resin particles can be prepared by a method such as polymerization methods, radiolysis methods and pyrolysis methods. Low-molecular-weight fluorocarbon resins have a good lubricant property. Since the resins mentioned above are nonpolar polymers having highly symmetric molecular structure, the intermolecular cohesive force thereof is very small. In addition, the surface of the molecular chain is very smooth. Because of having small intermolecular cohesive force, low-molecular-weight fluorocarbon resin particles can decrease the friction factor of the protective layer.

The content of fluorocarbon resin particles in the protective layer 39 is preferably from 20 to 60 parts by weight per 100 parts by weight of the binder resin included in the layer. When the content is too low, the desired friction factor cannot be obtained. In contrast, when the content is too high, the decrease of sensitivity and the increase of residual potential cannot be neglected, and deteriorates the mechanical strength of the layer.

The fluorocarbon resin particles in the protective layer 39 preferably have an average particle diameter of from 0.1 to 0.3 μm. When the particle diameter is too large, the irradiating light is scattered in the layer, resulting in deterioration of the image resolution. In contrast, when the particle diameter is too small, good abrasion resistance cannot be imparted to the resultant photoreceptor.

The protective layer 39 is typically prepared by spray coating a coating liquid, which is prepared by dispersing or dissolving the fluorocarbon resin particles and the binder resin in a solvent. The thickness of the protective layer 39 is preferably from 0.1 to 10 μm.

A solid lubricant can be coated to the surface of the photoreceptor to control the friction factor of the photoreceptor. Specific examples of the solid lubricants include fatty acid metal salts such as lead oleate, zinc oleate, copper oleate, zinc stearate, cobalt stearate, iron stearate, copper stearate, zinc palmitate, copper palmitate, zinc linolenate, etc.

When a solid lubricant is included in the protective layer 39, or coated on the surface of the protective layer 39, a contact member to rub the lubricant is preferably arranged in the image forming apparatus of the present invention. The cleaning blade can function as a contact member. Since the cleaning blade rubs the lubricant applied on the surface of the protective layer, the lubricant is flattened to form a thin layer, resulting in decreases of the friction factor of the surface of the photoreceptor.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Photoreceptor Manufacturing Example 1

Formation of Electroconductive Substrate

An aluminum alloy was subjected to DC casting to prepare an aluminum alloy billet. The billet was then subjected to hot extrusion to prepare a cylinder. The cylinder was cut so as to have a length of 340 mm. The surface of the cut cylinder was subjected to a cutting treatment using a lathe. Thus, an electroconductive substrate having an outside diameter of 30 mm and a ten-point mean roughness Rz of 1.2 μm was prepared.

Formation of Undercoat Layer

The surface of the electroconductive substrate was washed with water including a surfactant using a rotating brush, followed by washing with purified water.

The following components were mixed to prepare an undercoat layer coating liquid.

| | |
|---|---|
| Titanium oxide | 90 parts |
| Melamine resin | 10 parts |
| Alkyd resin | 15 parts |
| Methyl ethyl ketone | 150 parts |

The undercoat layer coating liquid was coated on an aluminum cylinder by a dip coating method and heated for 20 minutes at 130° C. to be thermoset. Thus, an undercoat layer having a thickness of 3.5 μm was prepared.

Formation of CGL

The formations of the CGL coating liquid is as follows.

At first, the following components were mixed to prepare a resin solution.

Bisazo pigment having the following formula 10 parts

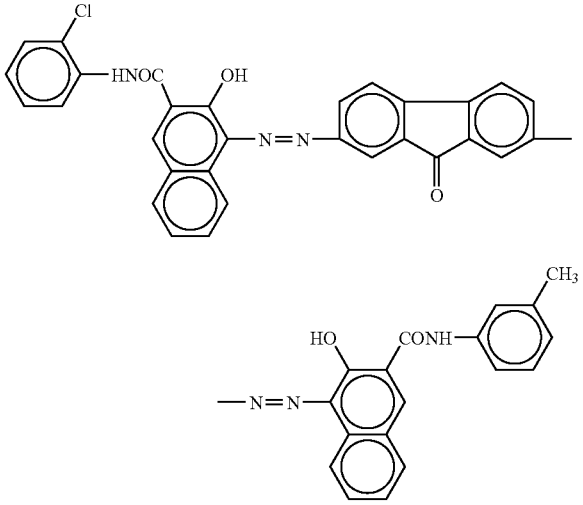

| | |
|---|---|
| Polyvinyl butyral resin (XYHL from Union Carbide Corp.) | 4 parts |
| Cyclohexanone | 150 parts |

Then the mixture was subjected to a dispersion treatment for 48 hours using a ball mill. Then 210 parts of cyclohexanone was added and the mixture was subjected to a dispersion treatment for 3 hours. Moreover, cyclohexanone was added to adjust the solid content of the mixture to 1.5% byweight. The thus prepared CGL coating liquid was coated on the undercoat layer by a dip coating method and dried for 20 minutes at 130° C. to prepare a CGL having a thickness of 0.2 μm.

Formation of CTL

The following components were mixed to prepare a resin solution.

| | |
|---|---|
| Bisphenol A-form polyarylate resin (U-100 from Unitika Ltd.) | 10 parts |

-continued

| | |
|---|---|
| Silicone oil | 0.002 parts |
| (KF-50 from Shin-Etsu Chemical Co., Ltd.) | |
| Tetrahydrofuran | 100 parts |

Then 10 parts of a charge transport material having the following formula was added to the resin solution to prepare a CTL coating liquid.

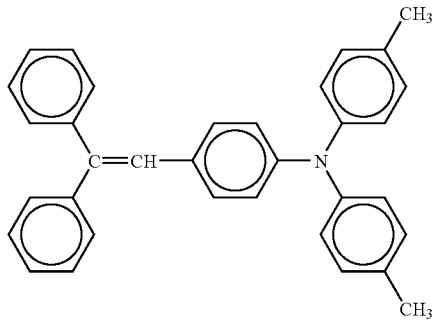

The CTL coating liquid was coated on the CGL by a dip coating method and then dried for 20 minutes at 130° C. to prepare a CTL having a thickness of 20 μm.

Thus, a photoreceptor (1) was prepared.

A flange made of a polycarbonate resin was engaged with each end of the photoreceptor. The flange was fixed to the end using an adhesive (BOND ARON ALPHA from Toagosei Co., LTD.)

Photoreceptor Manufacturing Example 2

The procedure for preparation of the photoreceptor in Example 1 was repeated except that the bisphenol A-form polyarylate resin in the CTL coating liquid was replaced with a polycarbonate-alloyed-form polyarylate resin (P-5001 from Unitika Ltd.)

Thus, a photoreceptor (2) was prepared.

Photoreceptor Manufacturing Example 3

The procedure for preparation of the photoreceptor in Example 1 was repeated except that the bisphenol A-form polyarylate resin in the CTL coating liquid was replaced with a bisphenol A-form polycarbonate resin.

Thus, a photoreceptor (3) was prepared.

Photoreceptor Manufacturing Example 4

The procedure for preparation of the photoreceptor in Example 1 was repeated except that the bisphenol A-form polyarylate resin in the CTL coating liquid was replaced with a bisphenol C-form polycarbonate resin.

Thus, a photoreceptor (4) was prepared.

Photoreceptor Manufacturing Example 5

The procedure for preparation of the photoreceptor in Example 1 was repeated except that the bisphenol A-form polyarylate resin in the CTL coating liquid was replaced with a resin having the following formula:

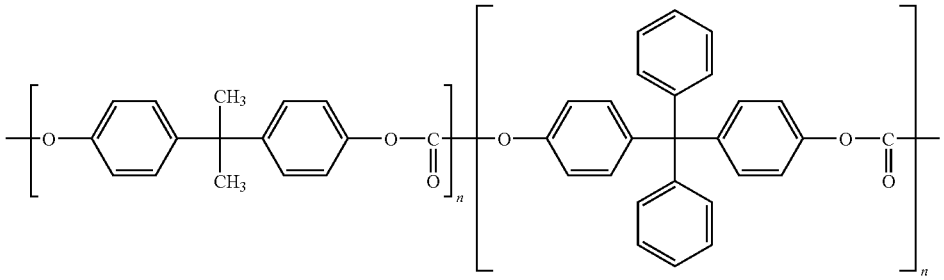

wherein n/m is 70/20.

Thus, a photoreceptor (5) was prepared.

Comparative Photoreceptor Manufacturing Example 1

The procedure for preparation of the photoreceptor in Example 1 was repeated except that the bisphenol A-form polyarylate resin in the CTL coating liquid was replaced with a phenoxy resin (PKHH from Union Carbide Corp.)

Thus, a comparative photoreceptor (1) was prepared.

Comparative Photoreceptor Manufacturing Example 2

The procedure for preparation of the photoreceptor in Example 1 was repeated except that the bisphenol A-form polyarylate resin in the CTL coating liquid was replaced with a norbornene resin (ARTON® F from JSR Corp.)

Thus, a comparative photoreceptor (2) was prepared.

Comparative Photoreceptor Manufacturing Example 3

The procedure for preparation of the photoreceptor in Example 1 was repeated except that the bisphenol A-form polyarylate resin in the CTL coating liquid was replaced with a resin having the following formula:

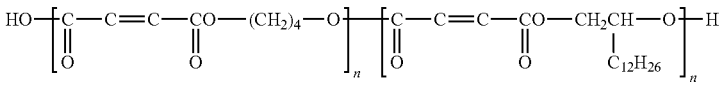

wherein n/m is 95/5.

Thus, a comparative photoreceptor (3) was prepared.

TABLE 1

| | $(T_0 - T_{400})/C$ |
|---|---|
| Photoreceptor 1 | 3.9 |
| Photoreceptor 2 | 3.1 |
| Photoreceptor 3 | 4.8 |
| Photoreceptor 4 | 3.8 |
| Photoreceptor 5 | 2.3 |
| Comparative photoreceptor 1 | 0.4 |
| Comparative photoreceptor 2 | 0.1 |
| Comparative photoreceptor 3 | 1.6 |

The binder resin used in each photoreceptor was dissolved in tetrahydrofuran at a concentration C of 8% by weight. In addition, the transmittance at 400 nm of the solution of the binder resin was measured to determine the initial transmittance $T_0$ and the 400-hour transmittance $T_{400}$ at 23° C. and 40% RH. The transmittance was measured with an automatic spectrophotometer UV-3100 manufactured by Shimadzu Corp. The results are shown in Table 1.

Toner Manufacturing Example 1 (Black)

Preparation of Particulate Resin

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 138 parts of styrene, 138 parts of methacrylic acid, and 1 part of ammonium persulfate were contained and the mixture was agitated with the stirrer for 15 minutes at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion (i.e., particle dispersion (1)) of a vinyl resin (i.e., a copolymer of styrene/methacrylic acid/sodium salt of sulfate of ethylene oxide adduct of methacrylic acid) was prepared.

Preparation of Low Molecular Weight Polyester

The following components were fed in a reaction vessel equipped with a condenser, a stirrer and a nitrogen feed pipe.

| | |
|---|---|
| Ethylene oxide (2 mole) adduct of bisphenol A | 220 parts |
| Propylene oxide (3 mole) adduct of bisphenol A | 561 parts |
| Terephthalic acid | 218 parts |
| Adipic acid | 48 parts |
| Dibutyltin oxide | 2 parts |

The mixture was reacted for 8 hours at 230° C. under normal pressure.

Then the reaction was further continued for 5 hours under a reduced pressure of from 10 to 15 mmHg.

Further, 45 parts of trimellitic anhydride was fed to the container to be reacted with the reaction product for 2 hours at 180° C. Thus, a low molecular weight polyester (1) was prepared.

Preparation of Prepolymer

The following components were fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 8 hours at 230° C. under normal pressure.

Then the reaction was further continued for 5 hours under a reduced pressure of from 10 to 15 mmHg. Thus, an intermediate polyester resin (1) was prepared. The intermediate polyester (1) had a number average molecular weight (Mn) of 2,100, a weight average molecular weight (Mw) of 9,500, a glass transition temperature (Tg) of 55° C., an acid value of 0.5 mgKOH/g and a hydroxyl value of 49 mgKOH/g.

In a reaction vessel equipped with a condenser, a stirrer and a nitrogen feed pipe, 411 parts of the intermediate polyester resin (1), 89 parts of isophorone diisocyanate and 500 parts of ethyl acetate were mixed and the mixture was heated at 100° C. for 5 hours to perform the reaction. Thus, a polyester prepolymer (1) having an isocyanate group was prepared.

Synthesis of Ketimine Compound

In a reaction vessel equipped with a stirrer and a thermometer, 170 parts of isophorone diamine and 75 parts of methyl ethyl ketone were mixed and reacted for 5 hours at 50° C. to prepare a ketimine compound (1).

Preparation of Oil Phase Liquid

In a reaction vessel equipped with a stirrer and a thermometer, 628 parts of the low molecular weight polyester (1), 110 parts of a carnauba wax, 22 parts of a charge controlling agent (salicylic acid metal complex E-84 from Orient Chemical Co., Ltd.), and 947 parts of ethyl acetate were mixed and the mixture was heated to 80° C. while agitated. After being heated at 80° C. for 5 hours, the mixture was cooled to 30° C. over 1 hour. Then 250 parts of a carbon black (REGAL 400R from Cabot Corp.) and 500 parts of ethyl acetate were added to the vessel, and the mixture was agitated for 1 hour to prepare a raw material dispersion (1).

Then 1324 parts of the raw material dispersion (1) were subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the low molecular weight polyester (1) prepared above was added thereto. The mixture was subjected to dispersion treatment using a bead mill. The dispersion conditions are the same as those mentioned above except that the dispersion operation was performed once (i.e., one pass).

Thus, a colorant/wax dispersion (1) was prepared.

Then the following components were mixed in a vessel.

| | |
|---|---|
| Colorant/wax dispersion (1) prepared above | 648 parts |
| Prepolymer (1) prepared above | 154 parts |
| Ketimine compound (1) prepared above | 6.6 parts |

The components were mixed for 1 minute using a mixer TK HOMOMIXER (trademark) from Tokushu Kika Kogyo K.K. at a revolution of 5,000 rpm. Thus, an oil phase liquid (1) was prepared.

Emulsification and Solvent Removal

Then, 990 parts of water, 80 parts of the particle dispersion (1) prepared above, 40 parts of an aqueous solution of a sodium salt of dodecyldiphenyletherdisulfonic acid (ELEMINOLMON-7 (trademark) from Sanyo Chemical Industries Ltd., solid content of 48.5%), and 90 parts of ethyl acetate were mixed while agitated for 20 minutes with a mixer TK HOMOMIXER (trademark) at a revolution of 13,000 rpm. As a result, an emulsion (1) was prepared.

The emulsion (1) was fed into a container equipped with a stirrer and a thermometer, and the emulsion was heated for 8 hours at 30° C. to remove the organic solvent (ethyl acetate) from the emulsion. Then the emulsion was aged for 4 minutes at 45° C. Thus, a dispersion (1) was prepared. The particles dispersed in the dispersion (1) have a volume average particle diameter of 4.95 μm and a number average particle diameter of 4.45 μm, which was measured with an instrument MULTISIZER II (trademark) from Macbeth Coulter Inc.

Washing and Drying

One hundred (100) parts of the dispersion (1) was filtered under a reduced pressure.

The thus obtained wet cake was mixed with 100 parts of ion-exchange water and the mixture was agitated for 10 minutes with a TK HOMOMIXER at a revolution of 12, 000 rpm, followed by filtering. This washing operation was performed three times. Thus, a wet cake (1) was prepared.

The wet cake (1) was dried for 48 hours at 45° C. using a circulating air drier, followed by sieving with a screen having openings of 75 μm. Thus, polymerization toner particles (1) were prepared.

Then 100 parts of the toner particles (1) were mixed with 0.7 parts of a hydrophobized silica and 0.3 parts of a hydrophobized titanium oxide using a HENSCHEL MIXER. Thus, a toner (1Bk) was prepared. Then the toner (1Bk) was mixed with particles having an average primary particle diameter of 120 nm and an apparent density of 0.51 g/cm$^3$. The apparent density was determined by the following equation:

$$d=C/100$$

wherein d represents the apparent density (g/cm$^3$), C represents a weight of the particles (g/100 ml). The weight C was determined as the difference between the weight of a 100 ml graduated cylinder and the weight of the cylinder after the particles were fed to the 100 ml graduated cylinder without applying vibration thereto.

Toner Manufacturing Example 1(Yellow)

The procedure for preparation of the toner in Example 1 (Black) was repeated except that the carbon black in the oil phase was replaced with C. I. Pigment Yellow 155.

Thus, a toner (1Y) was prepared.

Toner Manufacturing Example 1(Magenta)

The procedure for preparation of the toner in Example 1 (Black) was repeated except that the carbon black in the oil phase was replaced with C. I. Pigment Red 269.

Thus, a toner (1M) was prepared.

Toner Manufacturing Example 1(Cyan)

The procedure for preparation of the toner in Example 1 (Black) was repeated except that the carbon black in the oil phase was replaced with C. I. Pigment Blue 15:3.

Thus, a toner (1C) was prepared.

Comparative Toner Manufacturing Example 1(Black)

The procedure for preparation of the toner in Example 1 (Black) was repeated except that the solvent removal process was performed for 4 hours at 40° C.

Thus, a comparative toner (1Bk) was prepared.

Comparative Toner Manufacturing Example 1(Cyan)

The procedure for preparation of the toner in Example 1 (Cyan) was repeated except that the solvent removal process was performed for 4 hours at 40° C.

Thus, a comparative toner (1C) was prepared.

The average circularity of each of the thus prepared toners is shown in Table 2.

TABLE 2

| | Average Circularity |
|---|---|
| Toner 1Y | 0.93 |
| Toner 1M | 0.94 |
| Toner 1C | 0.97 |
| Toner 1Bk | 0.96 |
| Comparative toner 1C | 0.92 |
| Comparative toner 1Bk | 0.91 |

Evaluation of Photoreceptor (a) Cleanability

In order to evaluate the cleanability of the photoreceptors (1) and (5) and comparative photoreceptors (1) to (3), each photoreceptor was set in a copier (IMAGIO COLOR 8100 manufactured and modified by Ricoh Co., Ltd.) which uses the toners prepared above. Then a running test in which 20,000 copies are continuously produced was performed at room temperature and humidity. The produced images were visually observed to determine whether the images haveback-ground fouling caused by defective cleaning. The cleanability is graded as follows:

◎: The produced images have no background fouling.

○: The produced image have slight background fouling but no problem in use.

X: The produced images have background fouling.

(b) Granularity

Similarly to the evaluation of the cleanability, the photoreceptors and the toners were set in the copier mentioned above. Then gray half tone images were produced. The produced images were visually observed to evaluate the granularity of the half tone images. In this regard, "good granularity" is synonymous with "good dot reproducibility." In this case, high definition images can be produced.

The granularity is graded as follows:

◎: Very good

○: Good

X: Bad (c) Thin Line Reproducibility

Similarly to the evaluation of the cleanability, the photoreceptors and the toners were set in the copier mentioned above. Then black images of 1 dot grid lines having densities of 60 dot/inch and 150 line/inch, in the horizontal and vertical scattering directions, were respectively produced. The produced images were visually observed to determine whether the line images were cut or faded.

The thin line reproducibility is graded as follows:

◎: Very good

○: Good

X: Bad

The results are shown in Table 3.

TABLE 3

| | Toner | | | | | | | Thin line |
|---|---|---|---|---|---|---|---|---|
| | Y | M | C | Bk | Photoreceptor | Cleanability | Granularity | reproducibility |
| Ex. 1 | 1Y | 1M | 1C | 1Bk | 1 | ◎ | ◎ | ◎ |
| Ex. 2 | 1Y | 1M | 1C | 1Bk | 2 | ◎ | ◎ | ◎ |
| Ex. 3 | 1Y | 1M | 1C | 1Bk | 3 | ◎ | ○ | ○ |
| Ex. 4 | 1Y | 1M | 1C | 1Bk | 4 | ◎ | ○ | ○ |
| Ex. 5 | 1Y | 1M | 1C | 1Bk | 5 | ○ | ○ | ○ |
| Comp. Ex. 1 | 1Y | 1M | 1C | 1Bk | Comp. 1 | X | ○ | ○ |
| Comp. Ex. 2 | 1Y | 1M | Comp. 1C | Comp. 1Bk | Comp. 2 | X | X | X |
| Comp. Ex. 3 | 1Y | 1M | Comp. 1C | Comp. 1Bk | Comp. 3 | X | X | X |
| Comp. Ex. 4 | 1Y | 1M | Comp. 1C | Comp. 1Bk | 1 | ○ | X | X |

It is clear from Table 3 that the photoreceptor of the present invention has good cleanability, granularity and thin line reproducibility. In particular, photoreceptors 1 and 2 have exellent cleanability, granularity and thin line reproducibility. In contrast, comparative photoreceptor 1 has bad cleanability. Comparative photoreceptors 2 and 3 using another binder resin have bad cleanability, granularity and thin line reproducibility. In comparative example 4 in which the comparative toners 1C and 1Bk are used, the image have good cleanabilty but bad granularity and thin line reproducibility.

Photoreceptor Manufacturing Example 6

Formation of Undercoat Layer

The following components were mixed to prepare an undercoat layer coating liquid.

| | |
|---|---|
| Titanium oxide | 400 parts |
| Melamine resin | 65 parts |
| Alkyd resin solution | 120 parts |
| 2-butanone | 400 parts |

The undercoat layer coating liquid was coated on an aluminum cylinder and then dried. Thus, an undercoat layer having a thickness of 3.5 μm was prepared.

Formation of CGL

The following components were mixed to prepare a CGL coating liquid.

Bisazo pigment having the following formula 12 parts

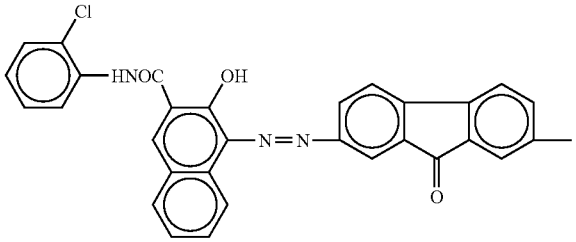

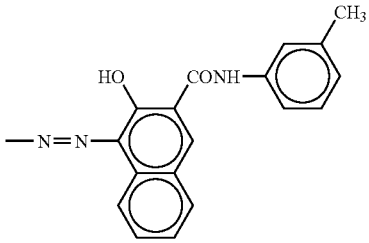

| | |
|---|---|
| Polyvinyl butyral resin | 5 parts |
| 2-butanone | 200 parts |
| Cyclohexanone | 400 parts |

The CGL coating liquid was coated on the undercoat layer and then dried to prepare a CGL having a thickness of 0.2 μm.

Formation of CTL

The following components were mixed to prepare a CTL coating liquid.

| | |
|---|---|
| Bisphenol Z-form polycarbonate having formula (1) ($(T_0 - T_{400})/C = 2.2$) | 8 parts |
| Polyester A listed in Table 1 below (weight average molecular weight of 1800) | 2 parts |
| CTM having the following formula | 10 parts |

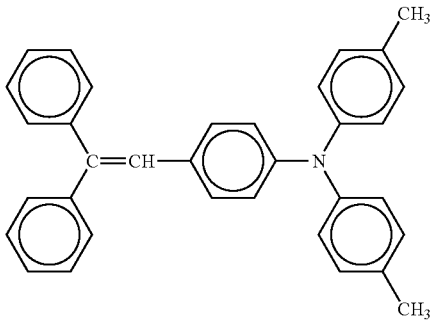

| | |
|---|---|
| Tetrahydrofuran | 100 |

The CTL coating liquid was coated on the CGL by a dip coating method and then dried for 20 minutes at 130° C. to prepare a CTL having a thickness of 22 μm.

Thus, a photoreceptor (6) was prepared.

Photoreceptor Manufacturing Example 7

The procedure for preparation of the photoreceptor in Example 6 was repeated except that the CTL coating liquid was replaced with the following CTL coating liquid.

CTL Coating Liquid

| | |
|---|---|
| Bisphenol Z-form polycarbonate having formula (1) ($(T_0 - T_{400})/C = 2.2$) | 8 parts |
| Polyester B listed in Table 1 below (weight average molecular weight of 1950) | 2 parts |
| CTM having the following formula | 10 parts |

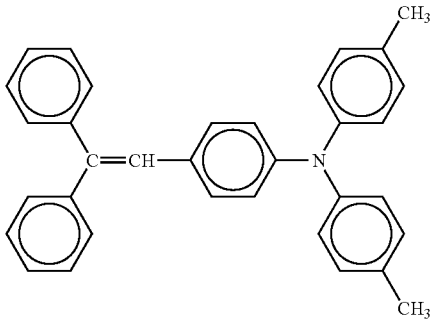

| | |
|---|---|
| Tetrahydrofuran | 100 |

Thus, a photoreceptor (7) was prepared.

Comparative Photoreceptor Manufacturing Example 4

The procedure for preparation of the photoreceptor in Example 6 was repeated except that the CTL coating liquid was replaced with the following CTL coating liquid.

CTL Coating Liquid

| | |
|---|---|
| Bisphenol Z-form polycarbonate having formula (1) ($(T_0 - T_{400})/C = 2.2$) (weight average molecular weight of 1950) | 10 parts |
| CTM having the following formula | 10 parts |

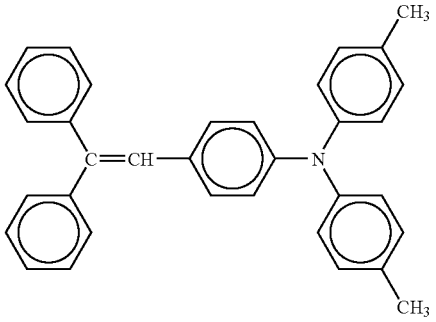

| | |
|---|---|
| Tetrahydrofuran | 100 |

Thus, a comparative photoreceptor (4) was prepared.

Comparative Photoreceptor Manufacturing Example 5

The procedure for preparation of the photoreceptor in Example 6 was repeated except that the CTL coating liquid was replaced with the following CTL coating liquid.

CTL Coating Liquid

| | |
|---|---|
| Bisphenol Z-form polycarbonate having formula (1) ($(T_0 - T_{400})/C = 2.2$) | 8 parts |
| Polyester C listed in Table 1 below (weight average molecular weight of 2150) | 2 parts |
| CTM having the following formula | 10 parts |

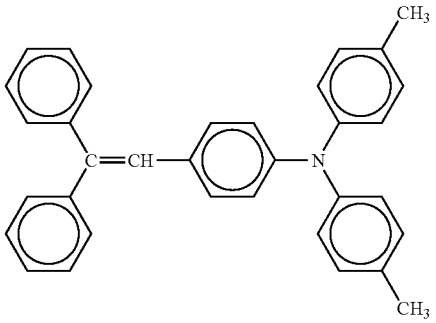

| | |
|---|---|
| Tetrahydrofuran | 100 |

Thus, a comparative photoreceptor (5) was prepared.

Comparative Photoreceptor Manufacturing Example 6

The procedure for preparation of the photoreceptor in Example 6 was repeated except that the CTL coating liquid was replaced with the following CTL coating liquid.

CTL Coating Liquid

| | |
|---|---|
| Bisphenol Z-form polycarbonate having formula (1) ($(T_0 - T_{400})/C = 4.8$) (weight average molecular weight of 1950) | 10 parts |
| CTM having the following formula | 10 parts |
| Tetrahydrofuran | 100 |

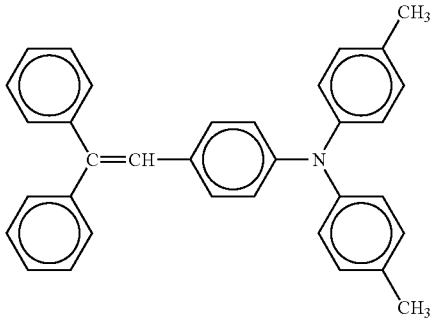

Thus, a comparative photoreceptor (6) was prepared.

TABLE 4

| | Crystallinity[1)] | Unit having Formula (A)[2)] | Acidic components | Alcoholic components |
|---|---|---|---|---|
| Polyester A | Yes (crystalline) | Yes | Fumaric acid/ adipic acid/ Dodecenyl succinic acid | Ethylene glycol/ 1,4-butane diol/ 1,6-hexane diol |
| Polyester B | Yes (crystalline) | Yes | Maleic acid/ Succinic acid | 1,4-butane diol/ 1,6-hexane diol |
| Polyester C | No (non-crystalline) | No | Terephthalic acid/trimellitic anhydride | EO/PO Bisphenol A* |

Crystallinity[1)]: "Yes" means that the polyester has an X-ray diffraction spectrum such that a diffraction peak is observed in each of Bragg (2θ) angle ranges of from 19° to 20°, 21° to 22°, 23° to 25° and 29° to 31°.
Unit having Formula (A)[2)]: "Yes" means that the polyester has a unit having formula A, which is determined by a solid $^{13}$C-NMR analysis.
EO/PO Bisphenol A*: Ethylene oxide/propylene oxide adducts of bisphenol A Whether the toner includes a group having formula (A) is determined by subjecting the toner to a solid $^{13}$C-NMR analysis under the following conditions.

Instrument used: FT-NMR SYSTEM JNM-α400 from JEOL Ltd.)
Measurement nucleus: $^{13}$C
Reference material: adamantane
Number of accumulation: 8192 times
Pulse sequence: CPMAS
IRMOD: IRLEV
Measurement frequency: 100.4 MHz
OBSET: 134500 Hz
POINT: 4096
PD: 7.0 sec
SPIN: 6088 Hz
Drawing software: CHEM DRAW PRO Ver. 4.5

Evaluation of Photoreceptor (d) Abrasion Loss

In order to evaluate the durability of the photoreceptors (1) and (2) and comparative photoreceptors (1) to (3), each photoreceptor was set in a copier (IMAGIO COLOR 8100 manufactured and modified by Ricoh Co., Ltd.) which uses the toner prepared above. Then a running test in which 50,000 copies are continuously produced was performed. The average thickness of the photosensitive layer of each photoreceptor was determined before and after the running test to determine the abrasion loss (i.e., the difference between the thickness before the running test and the thickness after the running test) of the photoreceptor.

(e) Cleanability

Similarly to the evaluation of the abrasion loss, the 50,000-copy running test was performed using each of the photoreceptors (1) and (2) and comparative photoreceptors (1) to (3). The produced images were visually observed to determine whether the images have background fouling caused by defective cleaning. The cleanability is graded as follows:

○: The produced images have no background fouling.

X: The produced images have background fouling.

The results are shown in Table 5.

TABLE 5

| | Abrasion loss (μm) | Cleanability |
|---|---|---|
| Example 6 | 2.2 | ○ |
| Example 7 | 2.0 | ○ |
| Comparative Example 4 | 2.8 | X |
| Comparative Example 5 | 2.1 | X |
| Comparative Example 6 | 4.6 | ○ |

It is clear from Table 5 that the photoreceptor of the present invention has such a good abrasion resistance as to be able to produce high quality images for a long period of time even when a spherical toner having a relatively small average particle diameter is used.

This document claims priority and contains subject matter related to Japanese Patenet Applications Nos. 2004-377980, 2005-032824 and 2005-151273, filed on Dec. 27, 2004, Feb. 9, 2005 and May 24, 2005, respectively, the entire contents of each of which are incorporated herein by reference.

Having now fully described the invention, it will be apparent to one of ordinary skill in the art that many changes and modifications can be made thereto without departing from the sprit and scope of the invention as set forth therein.

What is claimed as new and desired to be secured by letters patent of the United States is:

1. A photoreceptor comprising:

an electroconductive substrate; and a photosensitive layer located overlying the electroconductive substrate, wherein an outermost layer of the photoreceptor comprises a binder resin, wherein the binder resin comprises a polycarbonate resin and a crystalline polyester resin, wherein the crystalline polyester resin consists of units having the following formula (I):

$$[—O—CO—(CR_1{=}CR_2)_m—CO—O—(CH_2)_n—]_p \quad (I)$$

wherein each of R1 and R2 independently represents a hydrogen atom or a hydrocarbon group; and each of m, n and p is an integer;

wherein the outermost layer is prepared by a method comprising:

dissolving the binder resin in a solvent at a concentration of C % by weight;

coating a coating liquid comprising the binder resin solution; and drying the coated liquid, wherein the binder resin solution satisfies the following relationship (1):

$$2 \leqq (T_0 - T_{400})/C \quad (1)$$

wherein $T_0$ represents a initial transmittance(%) at 400 nm of the binder resin solution; $T_{400}$ represents a transmittance(%) at 400 nm of the binder resin solution which has been allowed to settle for 400 hours under conditions of 23° C. and 40%RH; and C represents the concentration of the binder resin solution; and wherein the polycarbonate resin solution satisfies the following relationship (2):

$$2 \leqq (T_0 - T_{400})/C \leqq 3 \quad (2).$$

2. The photoreceptor according to claim 1, wherein the crystalline polyester resin of formula (I) consists of units obtained from a diol having from 2 to 6 carbon atoms and a unit obtained from an acid selected from the group consisting of fumaric acid, maleic acid and succinic acid.

3. The photoreceptor according to claim 1, wherein the polycarbonate resin comprises a resin comprising a unit having the following formula (II):

(II)

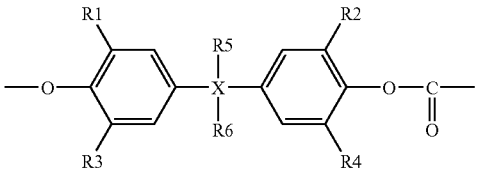

wherein X represents a carbon atom or a single bond (when X is a single bond, R5 and R6 do not exist); R1, R2, R3, and R4 each, independently, represent a hydrogen atom, a halogen atom, an alkyl group which may have a substituent group, or an aryl group; R5 and R6 each, independently, represent a hydrogen atom, a halogen atom, an alkyl group which may have a substituent group, a cycloalkyl group which may have a substituent group, or an aryl group, wherein R5 and R6 optionally share bond connectivity to form an alkylidene group.

4. The photoreceptor according to claim 1, wherein the polycarbonate resin comprises a resin comprising a unit having the following formula (III):

(III)

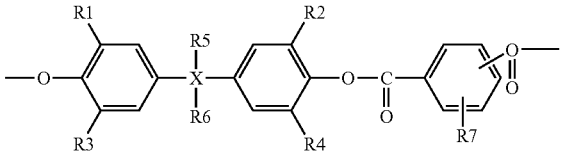

wherein X represents a carbon atom or a single bond (when X is a single bond, R5 and R6 do not exist); R1, R2, R3, and R4 each, independently, represent a hydrogen atom, a halogen atom, an alkyl group which may have a substituent group, or an aryl group; R5 and R6 each, independently, represent a hydrogen atom, a halogen atom, an alkyl group which may have a substituent group, an cycloalkyl group which may have a substituent group, or an aryl group, wherein R5 and R6 optionally share bond connectivity to form an alkylidene group; R7 represents a hydrogen atom, a halogen atom, an alkyl group which may have a substituent group, a cycloalkyl group which may have a substituent group, or an aryl group.

5. The photoreceptor according to claim 1, wherein the outermost layer further comprises a charge transport material.

6. The photoreceptor according to claim 1, wherein the photosensitive layer comprises a charge generation layer and a charge transport layer, and wherein the charge transport layer is the outermost layer.

7. The photoreceptor according to claim 1, further comprising a protective layer comprising a binder resin, wherein the protective layer is the outermost layer.

8. An image forming method comprising:

charging at least one image bearing member;

irradiating the charged image bearing member with image-wise light to form an electrostatic latent image on a surface of the at least one image bearing member;

developing the electrostatic latent image with a developer including a toner to form at least one toner image on the surface of the at least one image bearing member;

transferring the at least one toner image onto a transfer material optionally via an intermediate transfer medium; and cleaning the surface of the at least one image bearing member, wherein the at least one image bearing member is the photoreceptor according to claim 1, and the toner has an average circularity of from 0.93 to 0.99.

9. The image forming method according to claim 8, wherein the toner has a weight average particle diameter of from 2.5 to 6.5 μm.

10. The image forming method according to claim 8, wherein the toner comprises wax particles, and wherein the wax particles include particles having a particle diameter of from 0.1 to 1 μm in an amount of not less than 70% by number.

11. The image forming method according to claim 8, wherein the toner is prepared by a method comprising:

dissolving or dispersing a toner constituent mixture, comprising a polymer capable of reacting with an active hydrogen atom, a polyester resin, a colorant and a release agent, in an organic solvent to prepare a toner constituent mixture liquid; and dispersing the toner constituent mixture liquid in an aqueous medium while subjecting the polymer to at least one of an extension reaction or a crosslinking reaction using a compound having an active hydrogen atom, to prepare a dispersion including toner particles in the presence of a particulate resin.

12. The image forming method according to claim 8, wherein the toner comprises an external additive having an average primary diameter of from 50 to 500 nm, and an apparent density of not less than 0.3 g/cm$^3$.

13. The image forming method according to claim 8, wherein the cleaning comprises:

rubbing the surface of the image bearing member with a member.

14. The image forming method according to claim 8, wherein at least one member selected from the group consisting of a charging roller configured to charge the at least one image bearing member, a cleaning blade configured to clean the surface of the at least one image bearing member, a cleaning brush configured to clean the surface of the at least one image bearing member, the intermediate transfer medium and a member applying a solid lubricant agent to the surface of the at least one image bearing member, contacts the surface of the image bearing member.

15. The image forming method according to claim 8, wherein the irradiating is performed using a laser diode or a light emitting diode.

16. An image forming apparatus comprising:

an image bearing member;

a charger configured to charge the image bearing member;

a light irradiator configured to irradiate the charged image bearing member with imagewise light to form an electrostatic latent image on a surface of the image bearing member;

a developing device configured to develop the electrostatic latent image with a developer comprising a toner to form at least one toner image on the surface of the image bearing member;

a transferring device configured to transfer the toner image onto a transfer material optionally via an intermediate transfer medium; and a cleaner configured to clean the surface of the image bearing member, wherein the image bearing member is the photoreceptor according to claim 1, and the toner has an average circularity of from 0.93 to 0.99.

17. A process cartridge comprising:

an image bearing member configured to bear an electrostatic latent image thereon; and a developing device configured to develop the electrostatic latent image with a developer comprising a toner to form a toner image on the image bearing member, wherein the image bearing member is the photoreceptor according to claim 1, and the toner has an average circularity of from 0.93 to 0.99.

18. The photoreceptor according to claim 1, wherein the crystalline polyester resin of formula (I) consists of units obtained from a diol having from 2 to 6 carbon atoms and a unit obtained from an acid selected from the group consisting of fumaric acid and carboxylic acids having a carbon-carbon double bond.

19. The photoreceptor according to claim 1, wherein the crystalline polyester resin of formula (I) has an X-ray diffraction spectrum such that a diffraction peak exists in at least each 2θ angle range of 19° to 20° , 21° to 22° , 23° to 25° and 29° to 31° .

* * * * *